US008249469B2

(12) United States Patent
Sakamoto et al.

(10) Patent No.: US 8,249,469 B2
(45) Date of Patent: Aug. 21, 2012

(54) SUPPLY CONTROL APPARATUS, IMAGE-FORMING APPARATUS, AND SUPPLY CONTROL METHOD

(75) Inventors: Takashi Sakamoto, Kanagawa (JP); Naoya Yamasaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 335 days.

(21) Appl. No.: 12/604,747

(22) Filed: Oct. 23, 2009

(65) Prior Publication Data

US 2010/0247118 A1 Sep. 30, 2010

(30) Foreign Application Priority Data

Mar. 26, 2009 (JP) ..... 2009-077528
Jul. 10, 2009 (JP) ..... 2009-163852

(51) Int. Cl.
*G03G 15/08* (2006.01)

(52) U.S. Cl. ..... 399/27; 399/29

(58) Field of Classification Search ..... 399/9, 24–30, 399/58, 61, 252, 258–263
See application file for complete search history.

(56) References Cited

U.S. PATENT DOCUMENTS

2007/0058997 A1* 3/2007 Sakita et al. ..... 399/27
2008/0187357 A1* 8/2008 Miura et al. ..... 399/120
2008/0212989 A1* 9/2008 Nagata et al. ..... 399/61
2008/0285986 A1* 11/2008 Wada et al. ..... 399/27

FOREIGN PATENT DOCUMENTS

JP 2002-196551 A 7/2002

* cited by examiner

*Primary Examiner* — Hoan Tran
(74) *Attorney, Agent, or Firm* — Sughrue Mion, PLLC

(57) ABSTRACT

A supply control apparatus includes: a specifying unit that specifies a total amount of toner held in a holding chamber of a toner holding unit; and a supply control unit that controls supply of toner held in the holding chamber to a development unit that develops a latent image using the toner, in a case that the specified total amount is a first amount, such that an amount of the toner supplied per unit of time is smaller than the amount supplied in a case that the total amount is a second amount, which is smaller than the first amount.

7 Claims, 12 Drawing Sheets

SUPPLY CONTROL APPARATUS, IMAGE-FORMING APPARATUS, AND SUPPLY CONTROL METHOD

CROSS-REFERENCE TO RELATED APPLICATIONS

This application is based on and claims priority under 35 USC 119 from Japanese Patent Application No. 2009-163852 filed on Jul. 10, 2009 and No. 2009-77528 filed on Mar. 26, 2009.

BACKGROUND

1. Technical Field

The present invention relates to a supply control apparatus, an image-forming apparatus, and a supply control method.

2. Related Art

When toner in a developing unit is consumed, electrophotographic image-forming apparatuses replenish toner from a toner cartridge based on the consumed amount of toner, and maintain a toner density in the developing unit.

SUMMARY

According to an aspect of the invention, there is provided a supply control apparatus including: a specifying unit that specifies a total amount of toner held in a holding chamber of a toner holding unit; and a supply control unit that controls supply of toner held in the holding chamber to a development unit that develops a latent image using the toner, in a case that the specified total amount is a first amount, such that an amount of the toner supplied per unit of time is smaller than the amount supplied in a case that the total amount is a second amount, which is smaller than the first amount.

BRIEF DESCRIPTION OF THE DRAWINGS

Exemplary embodiments of the present invention will be described in detail based on the following figures, wherein.

DETAILED DESCRIPTION

An exemplary embodiment according to the present invention is described hereinafter. It should be noted that an electrophotographic printer (an image-forming apparatus) including an intermediate transfer belt and a so-called tandem engine is described here as an aspect of an exemplary embodiment of the present invention, but the present invention is not limited to this aspect. In addition, there may be omitted descriptions of general configurations including the image-forming apparatus such as configurations used in calibrating a density and quality of an image formed.

(A) FIRST EXEMPLARY EMBODIMENT

(A-1) Configuration

Figure 1:
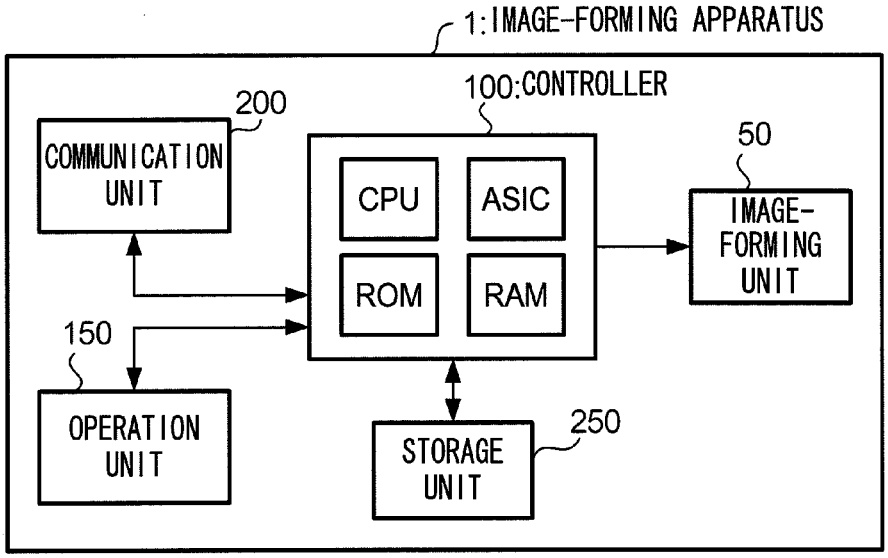
FIG. 1 is a block diagram showing configurations of an image-forming apparatus.

FIG. 1 is a block diagram showing configurations of an image-forming apparatus according to the first exemplary embodiment of the present invention. The image-forming apparatus 1 according to the first exemplary embodiment includes a controller 100, an image-forming unit 50, an operation unit 150, a communication unit 200, and a storage unit 250.

The controller 100 includes a Central Processing Unit (CPU) and an Application Specific Integrated Circuit (ASIC), a Read Only memory (ROM) and a Random Access Memory (RAM). The CPU executes a program stored in the ROM using the RAM as a work area to control various functions of the image-forming apparatus 1. The image-forming unit 50 is, for example, a printer, and forms an image by an electrophotographic image-forming process. The operation unit 150 includes an operation interface, such as buttons or the like and supplies operating information to the controller 100 in response to an operation by a user. The communication unit 200 is, for example, one or more modems, and includes an interface for transmitting data to and receiving data from external apparatuses. The storage unit 250 includes a data storage device such as a Hard Disk Drive (HDD), and, for example, stores image data supplied via the communication unit 200.

Figure 2:
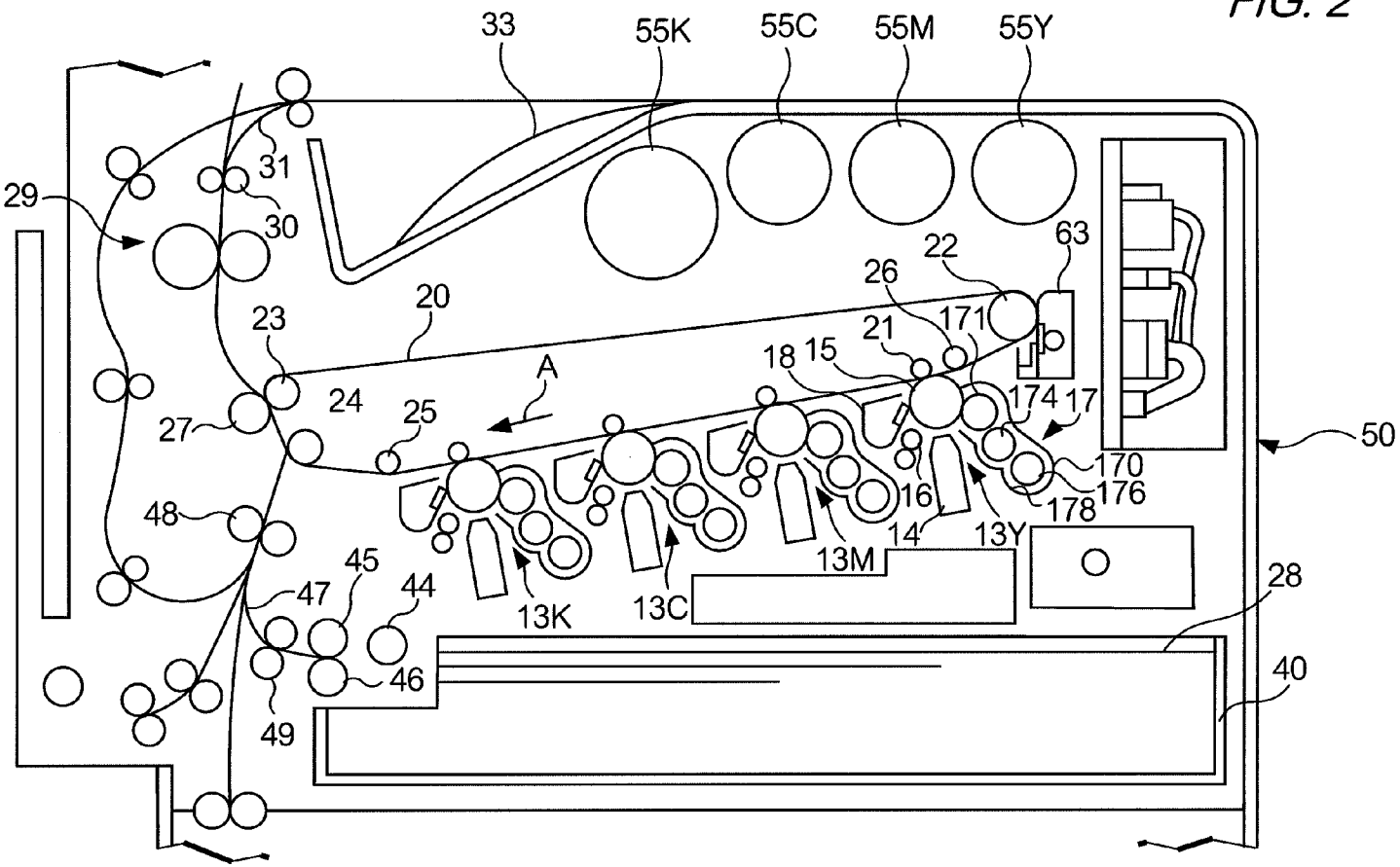
FIG. 2 is a diagram showing a configuration of the image-forming unit.

FIG. 2 shows a configuration of the image-forming unit 50. The controller 100 controls each part of the image-forming unit 50 described below. The controller 100 supplies image data of tone values of each pixel with four color components, yellow (y), magenta (M), cyan (C), and black (K), to a corresponding image-forming unit 13Y, 13M, 13C, 13K. In the following descriptions and drawings, suffixes including the letters "Y", "M", "C", and "K" indicate configurations relating to yellow, magenta, cyan, and black, respectively. In addition, those letters ("Y", "M", "C", and "K") placed at the end indicates the devices whose location and toner color used are different, but whose configuration is same. The final letter will be omitted in the following descriptions when there is no particular need to make a distinction between the devices.

The image-forming unit 13 includes a photosensitive drum 15, an exposure device 14, a charging device 16, a development unit 17, and a cleaning device 18. The photosensitive drum 15, which functions as an image supporter, is a cylindrical member having a photoconductive layer formed on its surface. The photosensitive drum 15 rotates around the center of the cylindrical member as an axis in a conjunction with a rotation of an intermediate transfer belt 20 when the photosensitive drum 15 is linked to the intermediate transfer belt 20. The charging device 16, which functions as a charging unit, charges the photoconductive layer forming the surface on the photosensitive drum 15 to a predetermined electric potential. The exposure device 14, which functions as an electrostatic latent image-forming unit, includes a laser illuminant, a polygon mirror, and so on, irradiates the charged photosensitive drum 15 and forms an electrostatic latent image on the surface based on exposure intensities and exposure locations controlled by the controller 100. The development unit 17 includes developing agents that are mixed toner and carrier together, and develops electrostatic latent images formed on the photosensitive drum 15 with toner. The development unit 17 moves the charged toner to the surface of the photosensitive drum 15 by the differences in electrical potential, and develops electrostatic latent images with toner.

Next, the development unit 17 and configuration thereof are described in detail.

The image-forming apparatus 1 uses a two-component development method using developing agents containing toner and carrier. Toner cartridges 55Y, 55M, 55C, 55K, which are examples of toner holders, each hold colored toner, yellow, magenta, cyan, and black, and supply toner to the development unit 17 of the corresponding image-forming unit 13Y, 13M, 13C, 13K, as necessary. However, the configurations used in this toner supply process are not shown in FIG. 2, to avoid complicating the drawing. The toner cartridges 55Y, 55M, 55C, 55K are removable from the image-forming apparatus 1. When, for example, all of the toner in the toner cartridge 55Y, 55M, 55C, or 55K is consumed and the toner cartridge becomes empty, the toner cartridge is removed from a mounting unit (not shown) of the image-forming apparatus 1 and is replaced by a new one.

The development unit 17 holds two-component developing agents inside a case 170. The developing agents contain carrier and toner supplied from the toner cartridge 55. A development roller 171, which functions as a developing agent supporter, is disposed in an opening portion on the case 170 at the side of the photosensitive drum 15. The development roller 171 consists of a fixed magnetic roller at its center and a rotatably supported development roller disposed on a circumference of the magnet roller. A supply auger 174, which functions as a developing agent supply member, is disposed on the obliquely lower right side of the development roller 171, and supplies developing agents to the development roller 171 while simultaneously agitating the developing agents. The developing agents, which are supplied to the development roller 171 by rotating the supply auger 174, are adsorbed onto a surface of the development roller 171 by magnetic attractive force of the magnet roller, their layer thickness is adjusted by a layer thickness adjusting member (not shown), and then it is carried to a development region where faces to the photosensitive drum 15. In addition, an agitating auger 176, which functions as a developing agents agitating member, is disposed on the further lower right side of the supply auger 174. A supply outlet to supply toner supplied from the toner cartridge 55 is disposed in a position on the upper side of the agitating auger 176 in the case 170. A density sensor 178, which functions as a density detection unit, is disposed in the lower side and at the rear of the case 170 in relation to operators of the agitating auger 176. The density sensor 178 detects a magnetic permeability of developing agents, and outputs a detection signal representing the magnetic permeability to the controller 100. The controller 100 specifies a toner density of developing agents in the development unit 17 based on the detection signal supplied from the density sensor 178.

The "auger" refers to a carrying member that includes pinnate members disposed around the rotating axis and carries developing agents around the rotating axis.

The development images of each color, which are developed by the development unit 17, are transferred onto the intermediate transfer belt 20 from the photosensitive drum 15 of each image-forming unit 13Y, 13M, 13C, 13K as a layer, by an action of a primary transfer roller 21, which functions as a transfer unit. The intermediate transfer belt 20 is an endless belt member that rotates in a direction shown by arrow "A" in the drawing, and is connected to a drive roller 22, a back up roller 23, a tension roller 24, a first idler roller 25, and a second idler roller 26. A recording medium 28 is carried to a register roller 48 from a supply tray 40 via a carry roller 49 and a carry path 47 by a supply roller 44 and a pair of rollers 45, 46 for carrying individual recording media, and stops there. Then the recording medium 28 is carried to a transfer position facing the intermediate transfer belt 20 by the register roller 48. A secondary transfer roller 27 is a cylindrical member that faces the back up roller 23 across the intermediate transfer belt 20, generates electrical potential such that a predetermined difference in electrical potential occurs between the back up roller 23 and the secondary transfer roller 27, and transfers a development image formed on a surface of the intermediate transfer belt 20 to a surface of the recording medium 28 at the transfer position. A fixing device 29 heats and pressures the recording medium 28 that is transferred a development image, and fixes the development image on the recording medium 28. The recording medium 28, on which a development image has been fixed by the fixing device 29, is forwarded onto a tray 33 via an exit roller 30 of the fixing device 29 and a paper output path 31.

Next, configurations to supply toner to each development unit 17 from each toner cartridge 55Y, 55M, 55C, 55K are described.

Figure 3:
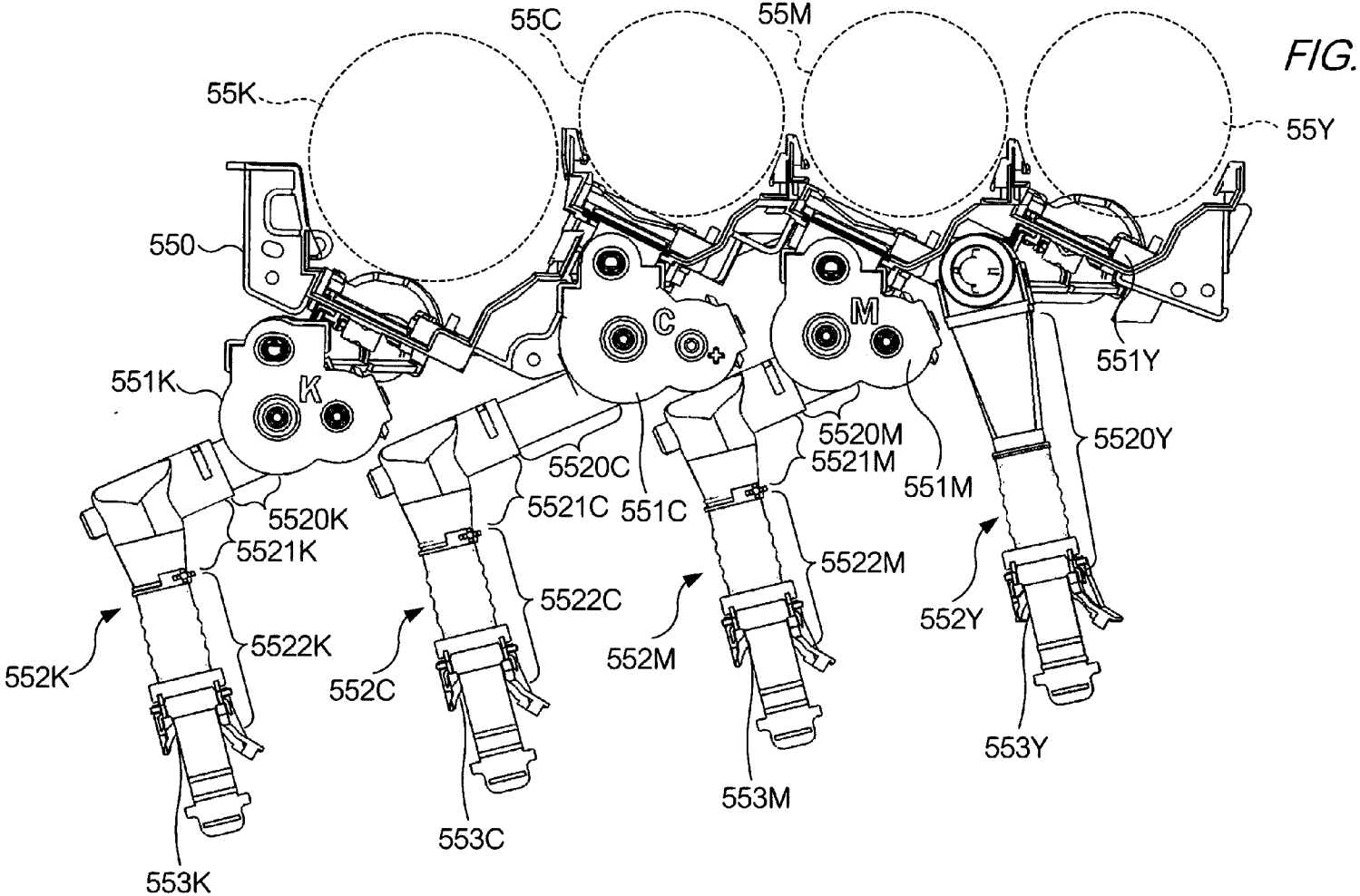
FIG. 3 is an enlarged elevation view showing relationships between configurations of toner cartridges.
Figure 4:
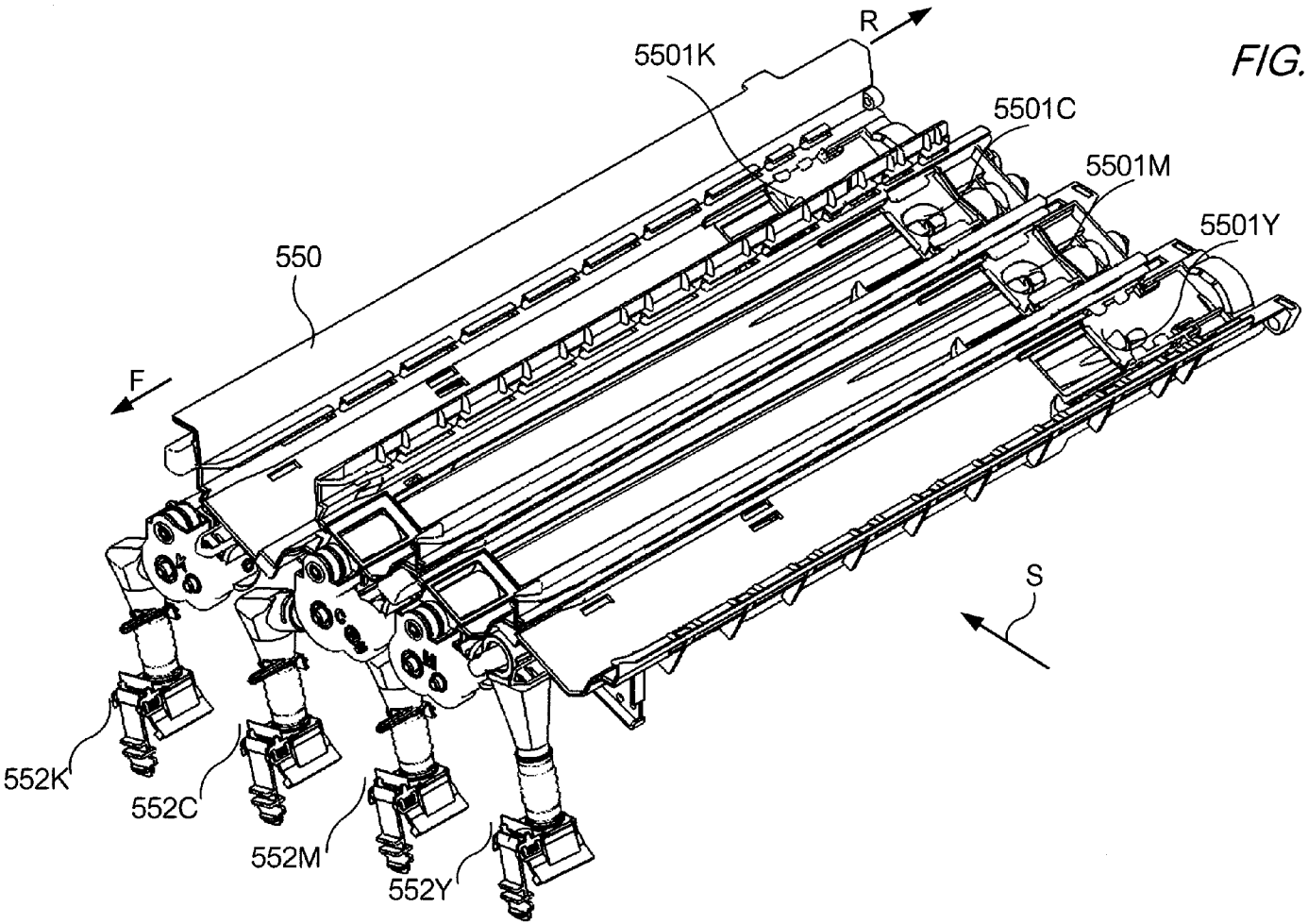
FIG. 4 is a perspective view of configurations shown in FIG. 3.

FIG. 3 is an enlarged elevation view showing relationships between configurations of the toner cartridges 55Y, 55M, 55C, 55K. FIG. 4 is a perspective view of the configurations shown as a solid line in FIG. 3. In FIG. 4, an arrow "F" indicates the front side and an arrow "R" indicates the rear side in relation to operators of the image-forming apparatus 1. The indication of the arrow "F" and the arrow "R" is also the same in subsequent drawings.

In FIG. 3, dotted line circles indicate the positions of the toner cartridges 55Y, 55M, 55C, 55K. The configurations to supply toner to the development unit 17 from a holding chamber of the toner cartridges 55Y, 55M, 55C, 55K are indicated by solid lines. As described above, the toner cartridges 55Y, 55M, 55C, 55K include the substantially cylindrical holding chamber respectively holding each color toner, yellow, magenta, cyan, and black. The toner cartridges 55Y, 55M, 55C, 55K are supported by a common toner cartridge supporter 550. Carry paths 551Y, 551M, 551C, 551K, which are examples of carry units, are disposed on the lower side of the toner cartridges 55Y, 55M, 55C, 55K. Carry paths 551Y, 551M, 551C, 551K include a cylindrical holding chamber respectively to carry toner supplied from the toner cartridges 55Y, 55M, 55C, 55K agitating the toner. An auger is disposed in the holding chamber, and the auger is rotated to carry toner. The toner is carried to the front side in the carry paths 551Y, 551M, 551C, 551K, passes supply ducts 552Y, 552M, 552C, 552K, and drops into the development unit 17 from supply outlets 553Y, 553M, 553C, 553K that open at the lower end of the supply ducts.

As shown in FIGS. 3 and 4, the supply ducts 552M, 552C, 552K, which correspond with the toner cartridges 55M, 55C, 55K, include first supply ducts 5520M, 5520C, 5520K, second supply ducts 5521M, 5521C, 5521K, third supply ducts 5522M, 5522C, 5522K, and supply outlets 553M, 553C, 553K respectively. The first supply ducts 5520M, 5520C, 5520K form a carry path extending straight to the obliquely lower left side as viewed in FIG. 3 from a link position to the carry paths 551M, 551C, 551K. The second supply ducts 5521M, 5521C, 5521K are linked to the first supply ducts 5520M, 5520C, 5520K, and form a carry path bending to the lower right side as viewed in FIG. 3. The third supply ducts 5522M, 5522C, 5522K are linked to the second supply ducts 5521M, 5521C, 5521K, and form a carry path extending straight to the obliquely lower right side as viewed in FIG. 3. The supply outlets 553M, 553C, 553K are linked to the supply outlets of the development unit 17. On the other hand, the supply duct 552Y, which corresponds with the toner cartridge 55Y, includes a first supply duct 5520Y and a supply outlet 553Y. The first supply duct 5520Y forms a carry path extending straight to the obliquely lower right as viewed in FIG. 3 from a link position to a carry path 551Y. The supply outlet 553Y is linked to a supply outlet of the development unit 17.

Holes for discharging toner are disposed on a circumferential surface of the toner cartridges 55Y, 55M, 55C, 55K. Holes 5501K, 5501C, 5501M, 5501Y are disposed on an upper surface of the toner cartridge supporter 550 at positions corresponding to those of the holes of toner cartridges 55Y, 55M, 55C, 55K, as shown in FIG. 4. The toner, which is discharged from the holes of the toner cartridges 55Y, 55M, 55C, 55K, drops into the holding chamber of the carry paths 551Y, 551M, 551C, 551K via the holes 5501Y, 5501M, 5501C, 5501K.

Figure 5:
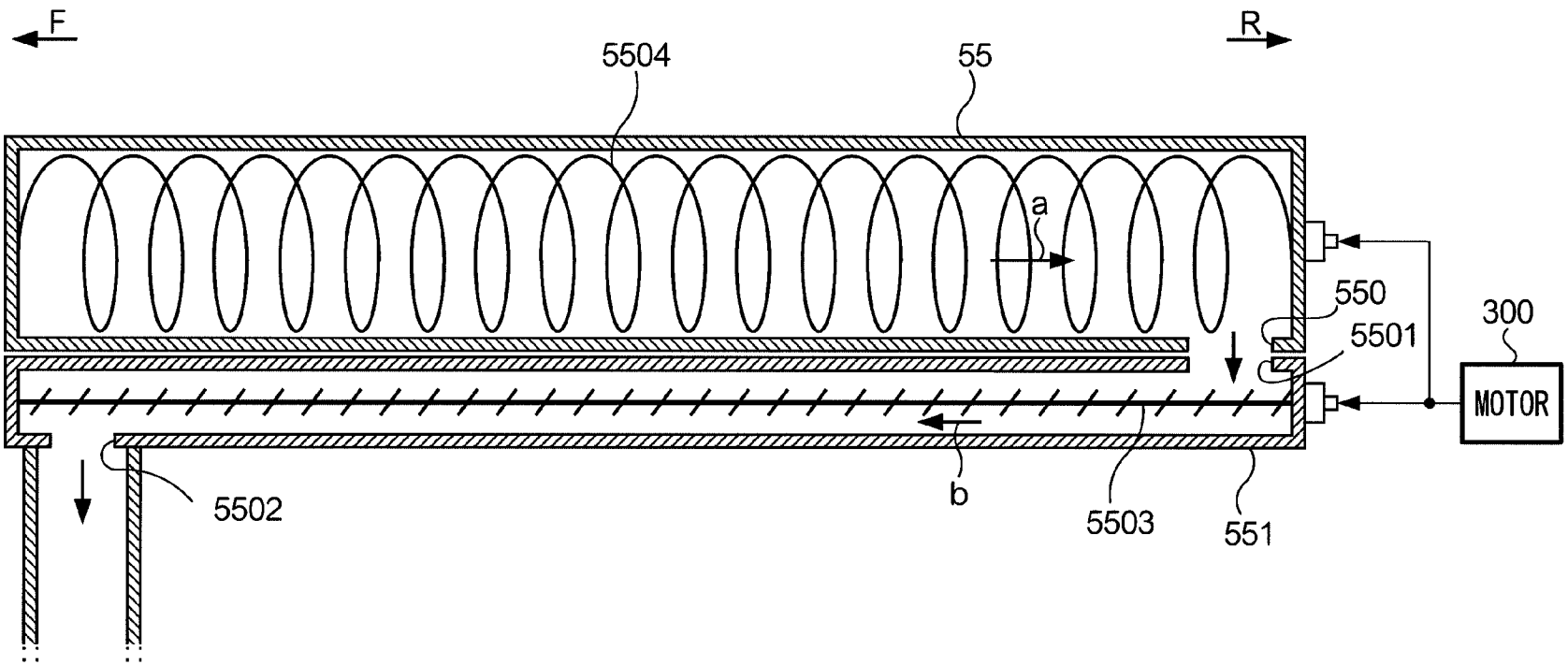
FIG. 5 is a sectional view showing configurations between the toner cartridges and carry paths disposed thereunder.

FIG. 5 is a sectional view showing the configurations as viewed in the direction shown by arrow "S" in FIG. 4, and simply shows structures of the toner cartridge 55 and the carry path 551 disposed thereunder.

A carry member 5504, which is a spirally coiled wire, is disposed in the holding chamber of the toner cartridge 55. The toner is carried in the direction shown by arrow "a" inside the holding chamber by rotating of the carry member 5504. The toner, which is carried to the end of the holding chamber, passes the hole 550 disposed in the bottom on the rear side of the toner cartridge 55 and the hole 5501 disposed in the upper on the rear side of the carry path 551, and drops into the holding chamber of the carry path 551. The auger 5503 is disposed in the holding chamber, as described above. The toner is carried in the direction shown by arrow "b" by rotating of the auger 5503. This toner passes the first supply duct 5520 and the supply outlet 553 from the hole 5502 disposed at the bottom on the front side of the carry path 551, and drops into the development unit 17. A motor 300, for example, a stepping motor, is a driving unit that rotates a rotating axis and generates driving force. The driving force generated by the motor 300 rotates the carry member 5504 and the auger 5503 in the toner cartridge 55.

The controller 100 performs a replenishment operation to replenish an amount of toner based on an amount of toner consumed to the development unit 17, when the image-forming unit 50 forms an image and toner in the development unit 17 is consumed. The controller 100 performs the replenishment operation by driving the motor 300 shown in FIG. 5. According to the replenishment operation, toner held in the toner cartridge 55 is carried and supplied to the development unit 17 via the carry path 551. An amount of toner supplied to the carry path 551 from the toner cartridge 55 or supplied to the development unit 17 from the carry path 551 is determined by a number of rotations and the drive time of the motor 300. The higher the number of rotations of the motor 300 is, the greater the amount of toner supplied in a unit of time is. Further, the longer the drive time of the motor 300 is, the greater the total amount of toner supplied is. Furthermore, an amount of toner carried from the toner cartridge 55 in a unit of time varies depending on a total amount of toner held in the toner cartridge 55 (that is, amount of toner held in the toner cartridge 55). More specifically, comparing a case that a large amount of toner is held in the toner cartridge 55 and the carry path 551, such as when a new toner cartridge 55 has been attached, with a case that much of the toner has been consumed and therefore a smaller amount of toner remains, although the controller 100 drives the motor 300 with the same number of rotations and for the same drive time, a greater amount of toner is carried in the former case. This is because the toner carrying efficiency varies according to the amount of toner held in the toner cartridge 55 and the carry path 551; that is, the higher the amount of toner held is, the more easily toner is carried and the higher the carry efficiency is. More specifically, the greater the volume occupied by toner in the volume of the toner cartridge 55 and the carry path 551 is, the higher the toner carrying efficiency is, and the smaller the volume is, the lower the toner carrying efficiency is. Therefore, the term "amount of toner held in the toner cartridge 55 and the carry path 551" refers to a ratio of toner in the toner cartridge 55 and the carry path 551, and is a relative amount, not an absolute amount. In this manner, toner carrying efficiency varies according to an amount of toner held in the toner cartridge 55 and the carry path 551, so if the controller 100 determines the drive time and the number of rotations of the motor 300 based solely on an amount of toner consumed in the development unit 17, an amount of toner supplied, which is determined according to a total amount of toner held in the toner cartridge 55, can fluctuate, whereby an excessive amount of toner is supplied, or the supplied toner is insufficient. Therefore the controller 100 performs an operation described below to control the replenishment operation.

(A-2) Operation

Figure 6:
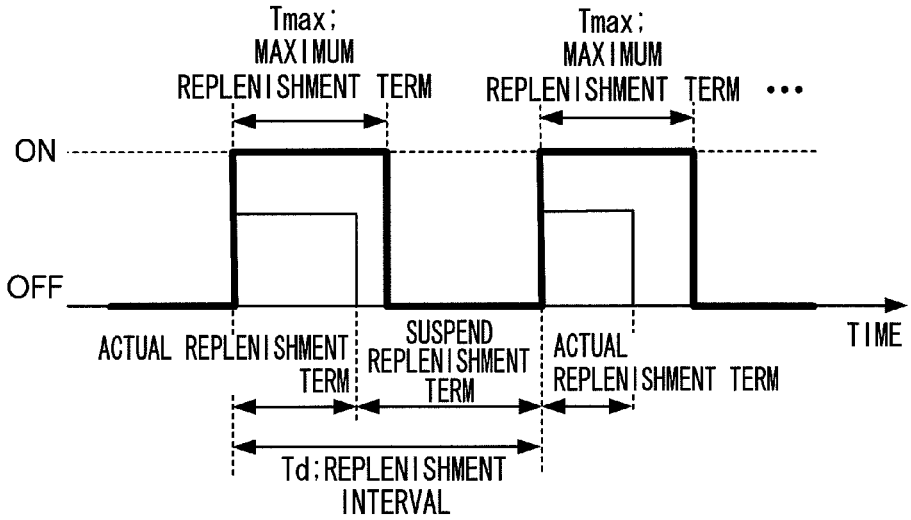
FIG. 6 is a timing diagram showing stages of a transitional state of a toner replenishing operation executed by the image-forming apparatus in chronological order.

(A-2-1) Setting of Maximum Replenishment Term Tmax and Replenishment Interval Td FIG. 6 is a timing diagram showing stages of a transitional state of a toner replenishing operation executed by the controller 100 in chronological order. In FIG. 6, transit of time is indicated by an arrow, "ON" shows a term of driving of the motor 300 and replenishing toner, and "OFF" shows a term without driving the motor 300 and replenishing toner.

The controller 100 alternates between a term of performing a replenishment operation (called "actual replenishment term" hereinafter) during which toner is supplied to the development unit 17, and a term of suspending the replenishment operation (called "suspend replenishment term" hereinafter) during which toner is not supplied to the development unit 17. The actual replenishment term is an example of a first term, and the suspend replenishment term is an example of a second term. The "suspend replenishment term" is set to prevent a situation that an excessive amount of toner is supplied to the development unit 17, by replenishing toner intermittently. The controller 100 sets a length of the "actual replenishment term" within the range of the maximum replenishment term Tmax, which is shown in FIG. 6. This maximum replenishment term Tmax is a maximum time of the "actual replenishment term". The replenishment interval Td expresses the timing when the controller 100 starts the actual replenishment term. The suspend replenishment term is uniquely determined based on the actual replenishment term and the replenishment interval Td. Also, the toner amount supplied to the development unit 17 from the toner cartridge 55 in a unit of time is determined depending on the length of each of the actual replenishment term and the replenishment interval Td, and on an amount of toner held in the toner cartridge 55 and the carry path 551. If the replenishment interval Td is fixed and the actual replenishment term is adjusted to extend, a greater amount of toner is supplied per unit of time, whereas if the actual replenishment term is adjusted to shorten, a smaller amount of toner is supplied per unit of time. In this manner, toner supply amount per unit of time is controlled with or without the replenishment operation according to the driving state of the motor 300.

The controller 100, which functions as a setting unit, sets the maximum replenishment term Tmax and the replenishment interval Td from an amount of toner held in the toner cartridge 55 and carry path 551.

Figure 7:
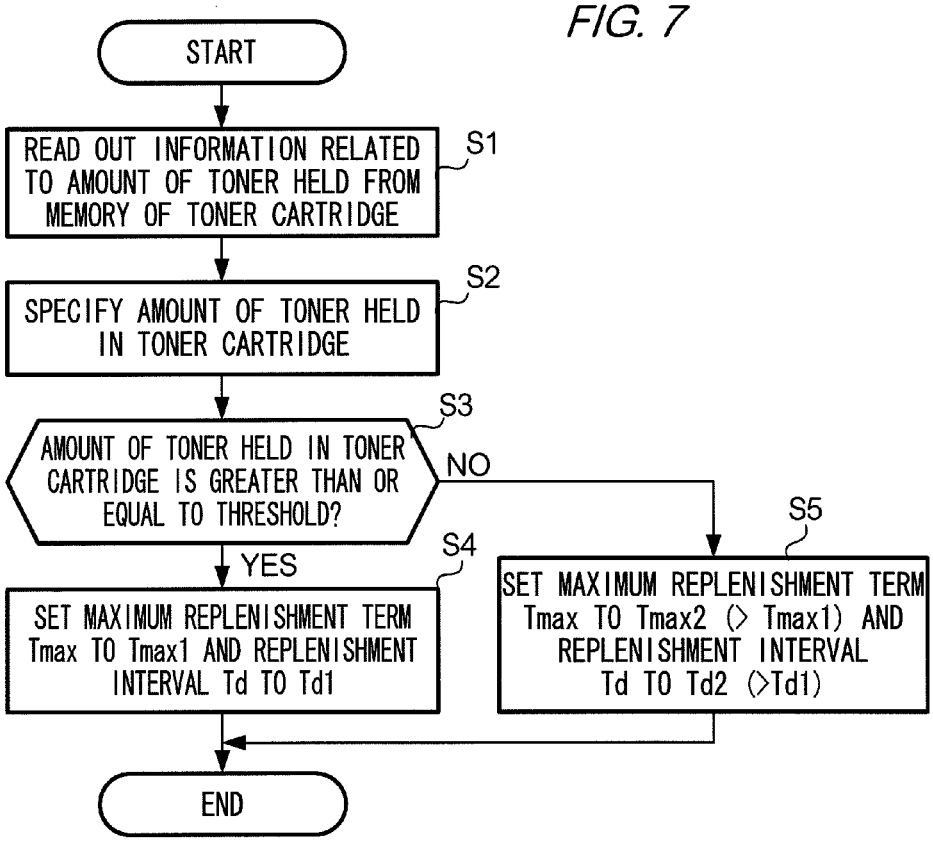
FIG. 7 is a flowchart showing a processing executed by the image-forming apparatus to set a maximum replenishment term Tmax and a replenishment interval Td.

FIG. 7 is a flowchart showing processing steps executed when the controller 100 sets the maximum replenishment term Tmax and the replenishment interval Td. FIG. 8 is a timing diagram showing stages of a transition state of the maximum replenishment time and the suspend term in chronological order. In FIG. 8, transit of time is shown by an arrow.

First, the controller 100 reads out information related to a remaining amount of toner from a memory of the toner cartridge 55 (step S1). The toner cartridge 55 includes the read-write memory, and the memory stores information related to an amount of toner remaining in the toner cartridge 55. For example, if the toner cartridge 55 is new, the memory stores information expressing that an amount of toner held is 50% of a holding space capacity in the toner cartridge 55 (the toner cartridge 55 has a capacity to be replenished by up to 50%). Then the toner is carried from the toner cartridge 55 by rotation of the motor 300, so the memory stores a value representing an amount determined by subtracting an amount calculated based on a total number of rotations of the motor 300 from the holding space capacity of the toner cartridge 55, as the amount of toner held at the time. Next, the controller 100 specifies an amount of toner held in the toner cartridge 55 based on the information read out in step S1 (step S2). Next, the controller 100 determines whether the amount specified in step S2 is greater than or equal to a threshold (step S3). The threshold is a value used as an indicator for judging whether sufficient toner is held in the toner cartridge 55. The threshold is a predetermined value stored in a control program.

Figure 8A:
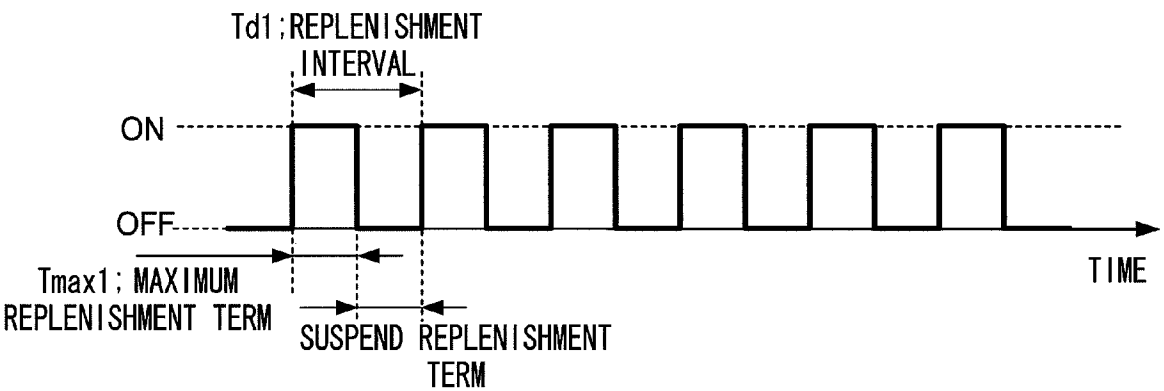
FIGS. 8A and 8B are diagrams to describe the maximum replenishment time and a suspend replenishment term.
Figure 8B:
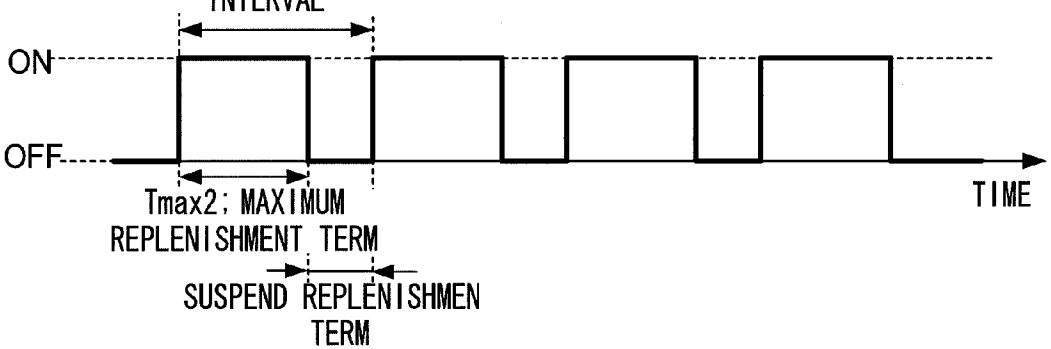

If the controller 100 determines that the amount is greater than or equal to the threshold (step S3; YES), it sets the maximum replenishment term Tmax to Tmax1 and the replenishment interval Td to Td1 (step S4). In other words, in a case that the amount of toner held in the toner cartridge 55 is sufficient, the controller 100 sets the maximum replenishment term Tmax1 and the replenishment interval Td1 that are comparatively short, as shown in FIG. 8A. Meanwhile, if the controller 100 determines that the amount is smaller than the threshold (step S3; NO), the controller 100 sets the maximum replenishment term Tmax to Tmax2 and the replenishment interval Td to Td2 (step S5). In other words, in a case that the amount of toner held in the toner cartridge 55 is small, the controller 100 sets the maximum replenishment term Tmax2 that is longer than the Tmax1, and the replenishment interval Td2 that is longer than the Td1, as shown in FIG. 8B.

In a case that the amount of toner held in the toner cartridge 55 is insufficient, toner carrying efficiency in the toner cartridge 55 and the carry path 551 is lower than in a case that the amount of toner held is large. Therefore, the controller 100 makes the maximum replenishment term Tmax longer when the amount of toner held is small, to supply enough toner within the actual replenishment term in a single operation. In other words, when the amount of toner held in the toner cartridge 55 is greater than or equal to the threshold, the controller 100, which functions as a supply control unit, sets the maximum replenishment term Tmax and the replenishment interval Td such that a ratio of the actual replenishment to the replenishment suspend term is smaller than the ratio in a case that the amount of toner held in the toner cartridge 55 is smaller than the threshold. In the amount of toner held in the toner cartridge 55, the amount greater than or equal to the threshold is an example of a first amount, and the amount smaller than the threshold is an example of a second amount.

The maximum replenishment term Tmax1 and Tmax2 is determined such that an excessive amount of toner is not supplied to the development unit 17, even if the actual replenishment term occupies all of the maximum replenishment term and toner is supplied during the term.

In the foregoing way, the controller 100 sets the maximum replenishment term Tmax and the replenishment interval Td, and stores the settings in the storage unit 250. Also, the controller 100, which functions as a holding amount specific unit, calculates a total number of rotations based on a total drive time and a number of rotations of the motor 300 at periodic intervals, calculates a value by subtracting an amount determined based on the number of rotations of the motor 300 from the holding space capacity of the toner cartridge 55 as an estimated value of an amount of toner held in the toner cartridge 55, and rewrites content of the memory of the toner cartridge 55. Further, the controller 100 carries out the foregoing calculation to set the maximum replenishment term Tmax and the replenishment interval Td at specified times, such as at periodic intervals, power-on, and so on. Note that the controller 100 may analyze image data supplied to the image-forming unit 50, calculate an amount of consumed toner by counting the colored pixel value expressed by the image data, and determine the amount of toner held in the toner cartridge 55 from the amount of toner consumed. Various configurations known heretofore are applied as a way to determine the amount of toner held.

(A-2-2) Calculation Process of Total Replenishment Time

Next, a "calculation process of total replenishment time," which calculates the total replenishment time T of the replenishing operation for replenishing toner when the controller 100 replenishes some toner, is described. The total replenishment time T will be determined based on a toner amount that should be supplied to the development unit 17 from the toner cartridge 55. In this first exemplary embodiment, the controller 100 calculates the total replenishment time T using both the "density detection method" and a "pixel count method." The "density detection method" specifies a toner density based on a result detected by the density sensor 178, and replenishes toner by a necessary amount, based on the detected density, to the development unit 17. The "pixel count method" counts a number of pixels of an image formed by the image-forming unit 50, and replenishes toner by a necessary amount, based on the count value, to the development unit 17.

First, calculation steps of the total replenishment time T by the density detection method are described below.

Figure 9:
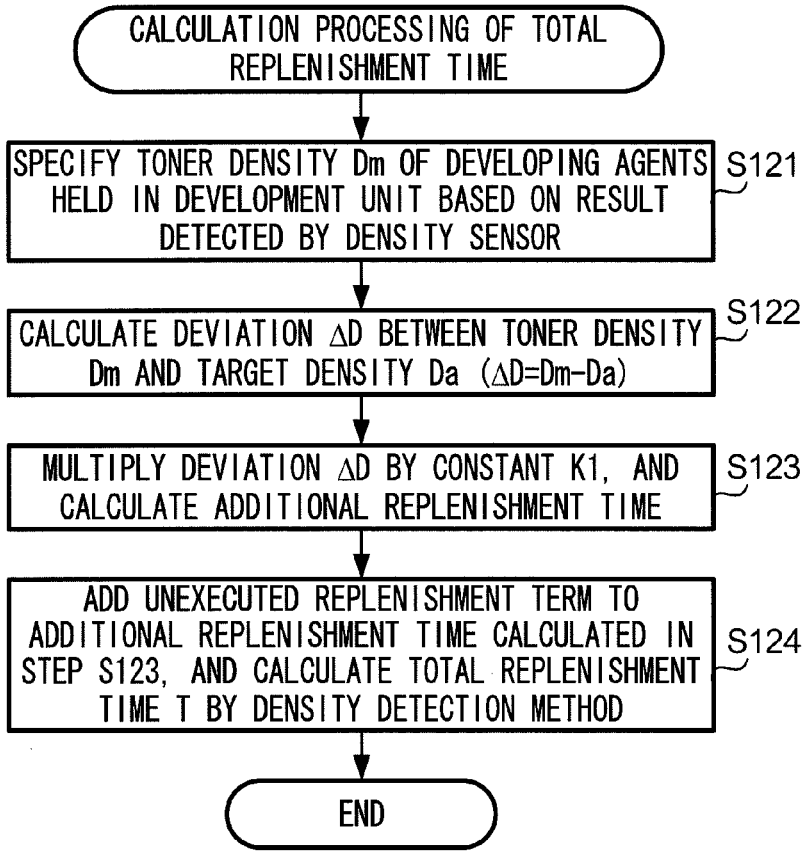
FIG. 9 is a flowchart showing a "calculation processing of total replenishment time" executed by the image-forming apparatus.

FIG. 9 is a flowchart showing processing steps executed when the controller 100 calculates the total replenishment time T by the density detection method.

First, the controller 100 detects a magnetic permeability in the development unit 17 by the density sensor 178, and specifies a toner density Dm of developing agents held in the development unit 17 based on the detected result (step S121). Next, the controller 100 calculates a deviation ΔD between the toner density Dm specified in step S121 and a target density Da (step S122). The target density Da expresses a density that should be kept constant in the development unit 17. For example, the target density Da is predetermined and stored in the control program. Next, the controller 100 multiplies the deviation ΔD calculated in step S122 by predetermined constant K1, and calculates an additional replenishment time to be added as time for performing the replenishing operation (step S123). The controller 100 adds an unexecuted replenishment term to the additional replenishment time calculated in step S123, and calculates the total replenishment time T by the density detection method (step S124). The total replenishment time is calculated by the density detection method in advance, but the unexecuted replenishment term is a period during which toner has not actually been replenished (the time is not added to the actual replenishment term). To determine the unexecuted replenishment term, the maximum time of the actual replenishment is subtracted from the maximum replenishment term Tmax. This will be described in detail hereinafter.

Next, calculation steps of the total replenishment time T by the pixel count method are described.

Figure 10:
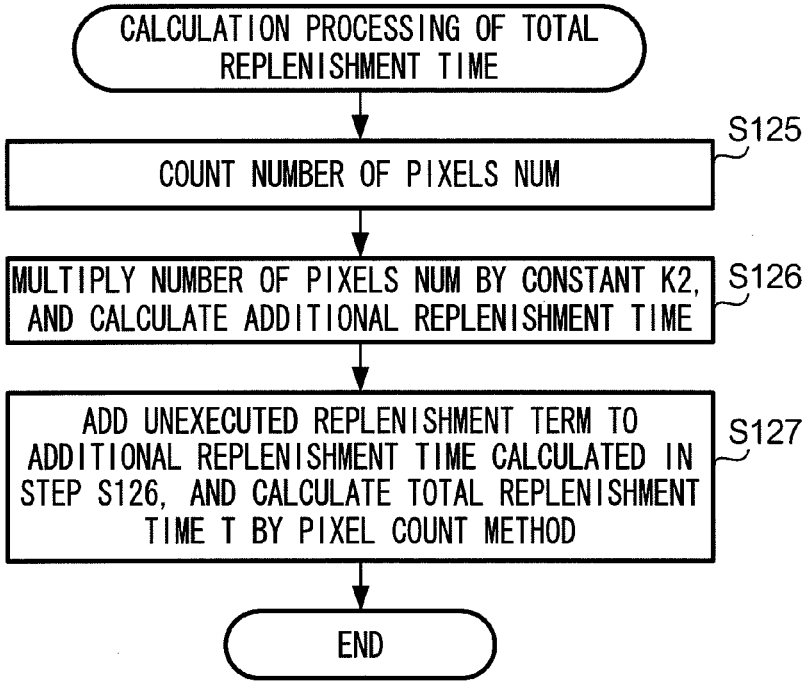
FIG. 10 is a flowchart showing a "calculation processing of total replenishment time" executed by the image-forming apparatus.

FIG. 10 is a flowchart showing processing steps executed when the controller 100 calculates the total replenishment time T by the pixel count method.

When the image-forming unit 50 forms an image, the controller 100 counts a number of pixels NUM based on colored pixels of the image data to be based on an image (step S125). For example, the controller 100 counts a number of exposure dots used when the exposure device 14 forms an electrostatic latent image on the surface of the photosensitive drum 15, and uses the counted value as the number of pixels NUM. Next, the controller 100 multiplies the number of pixels NUM calculated in step S125 by predetermined constant K2, and calculates an additional replenishment time (step S126). Also, the controller 100 adds an unexecuted replenishment term to the additional replenishment time calculated in step S126, and calculates the total replenishment time T by the pixel count method (step S127). The total replenishment time is calculated by the pixel count method in advance, but the unexecuted replenishment time is a period during which toner has not actually been replenished (the time is not added to the actual replenishment term). To determine the unexecuted replenishment term, also the maximum time of the actual replenishment is subtracted from the maximum replenishment term Tmax.

The controller 100 replenishes toner based on the replenishment operation using the total replenishment time T calculated by the "density detection method" and the total replenishment time T calculated by the "pixels count method", but there is another exemplary aspect using both of those methods; that is, the density detection method is applied at predetermined intervals and the pixel count method is applied during those intervals. If only the density detection method is applied, the controller 100 does not replenish toner until it is determined that the toner density in the development unit 17 has decreased. Therefore, owing to a time lag between when toner is consumed and when toner is replenished, if a high density image is being formed, especially an image having 100% density of one color or the like, the toner density in the development unit 17 fluctuates, and image density becomes unstable easily. However by also applying the pixel count method, the controller 100 counts a number of pixels of image data forming an image in advance, and replenishes toner by an amount determined based on the value counted at the time of or prior to an image-forming process, so the time lag between toner being consumed and replenished is shortened. Therefore, fluctuation of the toner density in the development unit 17 is reduced, and the image density becomes stable. Various means already known, for example, a method disclosed in JP-A-5-2003, and so on, may be applied to the aspect using both methods.

(A-2-3) Replenishment Operation of Toner

Figure 11:
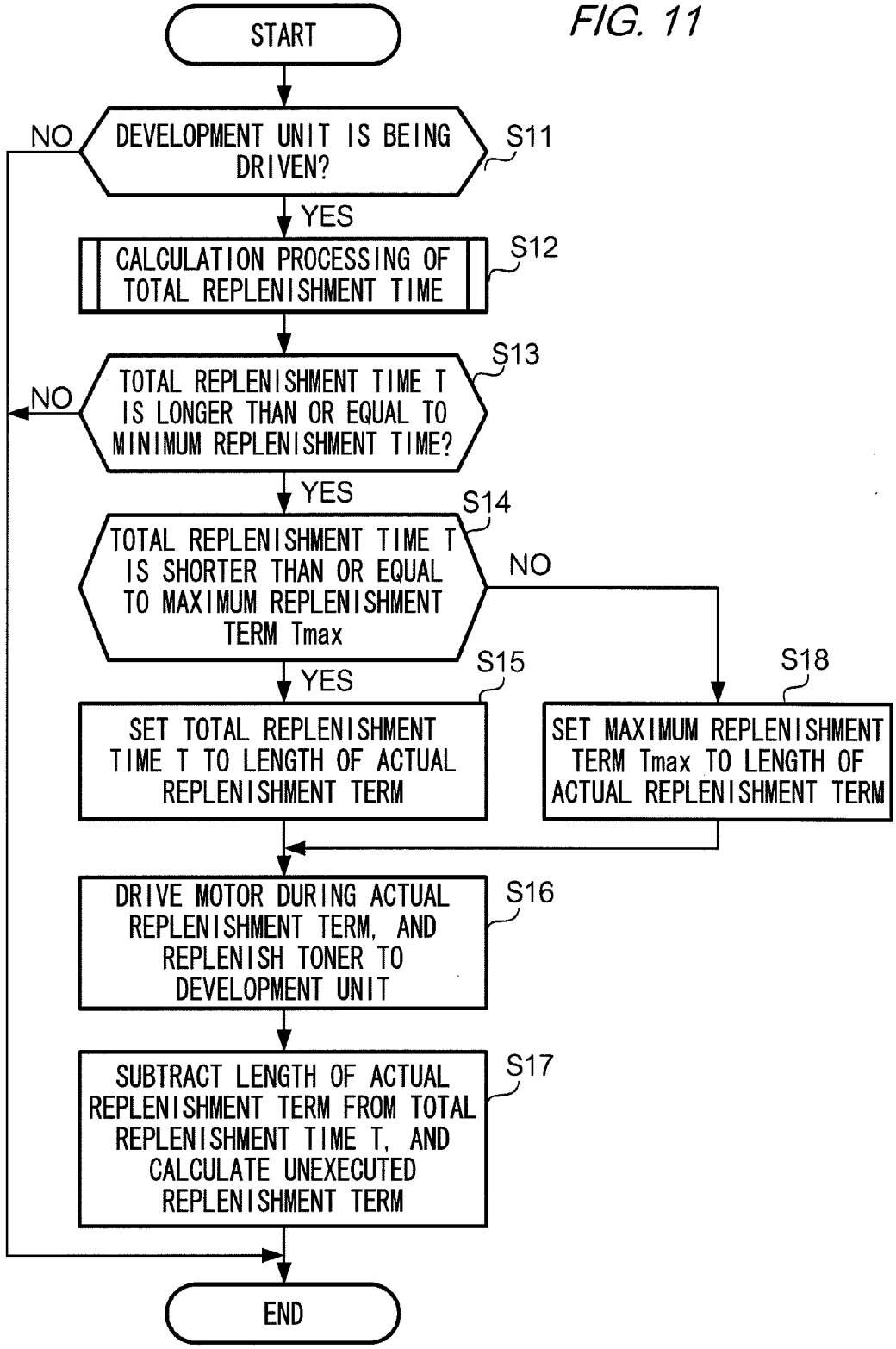
FIG. 11 is a flowchart showing a "toner replenishment operation" executed by the image-forming apparatus.
Figure 12:
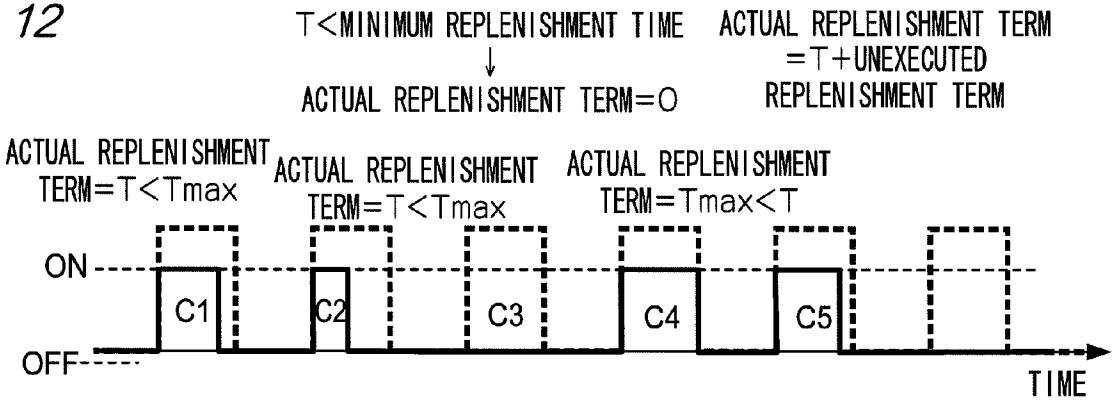
FIG. 12 is a timing diagram showing stages of a transition state of the "toner replenishment operation" executed by the image-forming apparatus in chronological order.

Next details of a replenishment operation of toner executed by the controller 100 are described, with reference to FIGS. 11 and 12. FIG. 11 is a flowchart showing processing steps of a "toner replenishment operation" executed by the controller 100. FIG. 12 is a timing diagram showing stages of a transition state of the toner replenishment operation executed by the controller 100 in chronological order. In FIG. 12 and other timing diagrams referred to in the following description, transit of time is indicated by an arrow, "ON" shows a term of driving of the motor 300, and "OFF" shows a term without driving the motor 300. In addition, dotted lines show the maximum replenishment term Tmax1 in FIG. 12. Here the maximum replenishment term Tmax shall be set to the maximum replenishment term Tmax1, and the replenishment interval Td shall be set to the replenishment interval Td1.

First, the controller 100 determines whether the development unit 17 is being driven (step S11). If the development unit 17 is being driven, it means that toner is being consumed, for example, in a case that the development unit 17 forms an electrostatic latent image. If the controller 100 determines that the development unit 17 is not being driven (step S11; NO), there is no need to replenish toner to the development unit 17, so the process ends. If the controller 100 determines that the development unit 17 is being driven (step S11; YES), it executes a "calculation processing of total replenishment time," and calculates the total replenishment time T (step S12). A detail of the "calculation processing of total replenishment time" is as described in the paragraph "(A-2-2) Calculation Process of Total Replenishment Time."

When the controller 100 calculates the total replenishment time T in step S12, and it determines whether the total replenishment time T is longer than or equal to a predetermined minimum replenishment time (step S13). The minimum replenishment time defines a minimum length of the actual replenishment term during execution of the toner replenishment operation. The controller 100 determines that the total replenishment time T is longer than or equal to the minimum replenishment time (step S13; YES), and proceeds to step S14. Next, the controller 100 determines whether the total replenishment time T is shorter than or equal to the maximum replenishment term Tmax (here, the maximum replenishment term Tmax1) (step S14).

The controller 100 determines that the total replenishment time T is shorter than or equal to the maximum replenishment term Tmax (step S14; YES), and it sets the total replenishment time T to the length of the actual replenishment term (step S15). The controller 100 drives the motor 300 during the actual replenishment term set in step S15, performs the replenishment operation, and replenishes toner to the development unit 17 (step S16). In step S16, the actual replenishment term is shorter than the maximum replenishment term Tmax, as shown in section C1 in FIG. 12. Further, the controller 100 subtracts a time of the actual replenishment term from the total replenishment time T calculated in step S12, and calculates the unexecuted replenishment term (step S17). The unexecuted replenishment term used in step S124 and S127 of "the calculation process of replenishment time" is also calculated at step S17. Here, the total replenishment time T and the actual replenishment term are the same length, so the controller 100 calculates "0" to express that no unexecuted replenishment term is present.

During the term the development unit 17 is being driven, the controller 100 repeatedly performs an operation by carrying out the foregoing steps. For example, the controller 100 carries out steps from step S11 to step S17 in order, sets the actual replenishment term to be shorter than the maximum replenishment term Tmax, and also performs replenishment operation here. Next, in a case that the controller 100 executes the processing in steps S11 and S12, and determines that the total replenishment time T is shorter than the minimum replenishment time in step S13 (step S13; NO), and it ends the processing without toner replenishing In the case that the total replenishment time T is shorter than the minimum replenishment time, toner density Dm in the development unit 17 only minimally decreases from the target density Da, so toner replenishing is not needed here. Therefore, in this case, the controller 100 does not perform the replenishment operation, as shown in section C3 in the timing diagram of FIG. 12.

In step S14, the controller 100 determines that the total replenishment time T is longer than the maximum replenishment term Tmax (step S14; NO), and it proceeds to step S18. The controller 100 sets the maximum replenishment term Tmax (=Tmax1) to the length of the actual replenishment term (step S18). The controller 100 performs the replenishment operation during the maximum replenishment term Tmax set in step S18, and replenishes toner to the development unit 17 (step S16). In this case, if the total replenishment time T is longer than the maximum replenishment term Tmax, the controller 100 sets the maximum replenishment term Tmax to the length of the actual replenishment term, and performs the replenishment operation within a time range of the maximum replenishment term Tmax. The controller 100 subtracts the actual replenishment term from the total replenishment time T calculated in step S12 as the unexecuted replenishment term (step S17). Here, the actual replenishment term is shorter than the total replenishment time T, so the controller 100 adds the term obtained as a result of the subtraction to the subsequent unexecuted replenishment term. In this manner, the controller 100 performs the replenishment operation in such a way that an excessive amount of toner is not supplied to the development unit 17, maintaining a toner density level in the development unit 17.

Even when the maximum replenishment term Tmax is set to Tmax2, the controller 100 performs the replenishment operation by carrying out the foregoing steps. In this case, the length of the actual replenishment term is longer than that in a case that the maximum replenishment term Tmax is Tmax1, but toner carrying efficiency in the toner cartridge 55 decreases compared to that in a case that an amount of toner held is large, as in the foregoing description, so an excessive amount of toner is never supplied to the development unit 17. In this manner, the controller 100 brings a toner density in the development unit 17 close to the target density without supplying an excessive amount of toner to the development unit 17.

In the first exemplary embodiment described above, the controller 100 sets the maximum replenishment term Tmax and the replenishment interval Td based on the amount of toner held in the toner cartridge 55. If a large amount of toner is held, the controller 100 shortens the maximum replenishment term Tmax, controls an amount of toner supplied per unit of time to be smaller, and controls fluctuation of the supplied amount to be smaller based on the amount of toner held in the toner cartridge 55. By this control process, the fluctuation of the toner amount supplied to the development unit 17 can be kept small regardless of a total amount of toner held in the toner cartridge 55, and an excessive amount of toner is never supplied to the development unit 17, owing to the action of the maximum replenishment term Tmax. If the toner density in the development unit 17 is excessively high, agitation failures of the agitating auger 176 occur, whereby, for example, toner clumps adhere to the development roller 171, streaky marks are formed on the recording paper 28, or fogging occurs. But this first exemplary embodiment restrains occurrence of such problems. Furthermore, the controller 100 performs the replenishment operation during the actual replenishment term based on the amount of toner held in the toner cartridge 55, so there is no occurrence that the toner density level significantly decreases owing to the actual replenishment term being shortened more than necessary, and a term for the control to bring a toner density in the development unit 17 close to the target density takes a long time.

(B) SECOND EXEMPLARY EMBODIMENT

Next, a second exemplary embodiment according to the present invention is described.

In this second exemplary embodiment, the controller 100 performs different controls, but the configuration of the image-forming apparatus 1 is same as that in the first exemplary embodiment. Therefore, the same configurations as described in the first exemplary embodiment are labeled using the same letters and numbers, and descriptions of the configurations are omitted.

After the toner cartridge 55 is replaced, the image-forming apparatus 1 performs a control called "toner recovery" to operate the apparatus normally. The toner recovery refers to an operation to return the apparatus to normal condition when the image-forming unit 50 starts driving. This toner recovery is performed when, for example, all of the toner in the toner cartridge 55 is consumed, the toner cartridge 55 becomes empty and is replaced by a new one. When the toner cartridge 55 is replaced by a new one, the controller 100 supplies toner to the development unit 17 and the carry path 551 from the toner cartridge 55, but in this second exemplary embodiment, it replenishes toner based on an amount of toner held in the toner cartridge 55 to avoid an excessive amount of toner being supplied for the same reason as described in the first exemplary embodiment. However, immediately after the toner cartridge 55 is replaced, the toner in the carry path 551 and in the development unit 17 is not present, or significantly decreases. In the second exemplary embodiment, to support such a problem, toner is replenished to the carry path 551 from the toner cartridge 55 in advance. In the following descriptions, this toner replenishment is called "toner filling."

(B-1) Setting of Filling Time Tm and Replenishment Interval Td

The controller 100 sets lengths of a filling time Tm and the replenishment interval Td from an amount of toner held in the toner cartridge 55. The filling time Tm is a total time of the replenishment operation performed to fill toner to the carry path 551 from the toner cartridge 55. As described above, immediately after the toner cartridge 55 is replaced, the toner in the carry path 551 and the development unit 17 is not present, or significantly decreases, so if toner is not filled to the carry path 551 at the beginning, toner would not immediately be replenished to the development unit 17 from the carry path 551 when toner replenishment is needed. The replenishment interval Td is as described in the first exemplary embodiment, but here a length of the actual replenishment term and a length of the suspend replenishment term are uniquely determined based on the replenishment interval Td.

Figure 13:
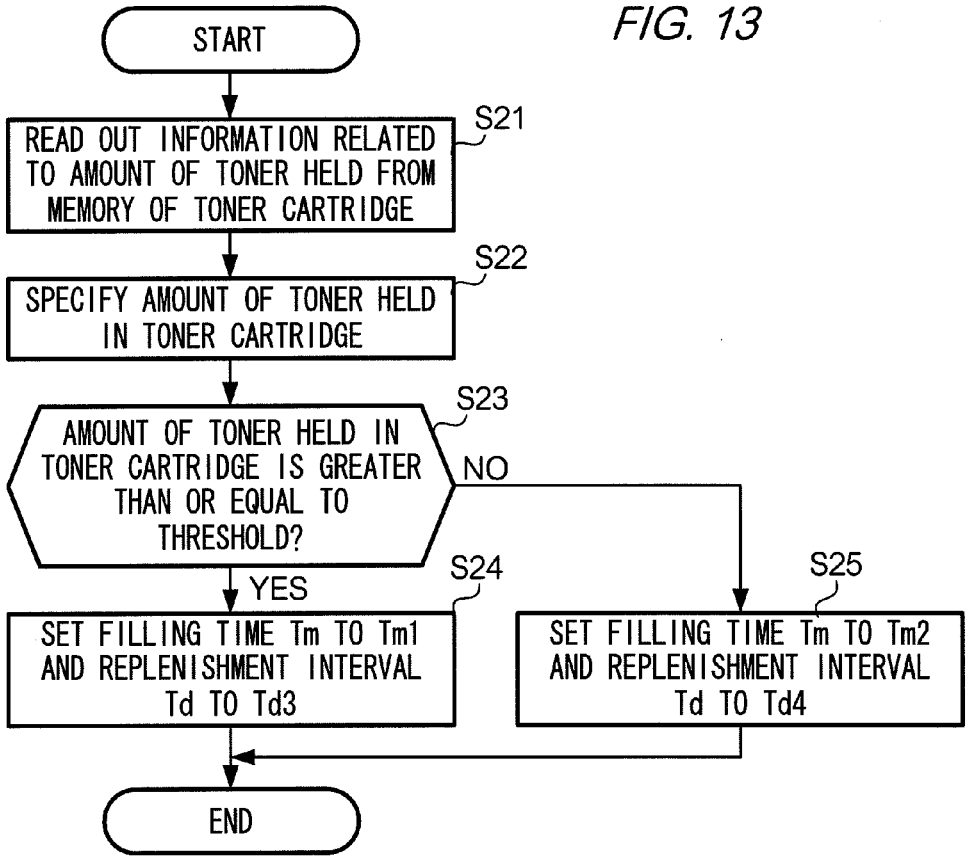
FIG. 13 is a flowchart showing a processing to set a filling time Tm and a replenishment interval Td executed by the image-forming apparatus according to second exemplary embodiment of the present invention.

FIG. 13 is a flowchart showing processing steps executed by the controller 100 in setting operation of the filling time Tm and the replenishment interval Td.

The controller 100 reads out information related to a remaining amount of toner from the memory of the toner cartridge 55 (step S21). Next, the controller 100 specifies an amount of toner held in the toner cartridge 55 based on the information read out in step S21 (step S22). Next, the controller 100 determines whether the amount specified in step S22 is greater than or equal to a threshold (step S23). The threshold is a value used as an indicator for judging whether sufficient toner is held in the toner cartridge 55. The threshold is a predetermined value stored in the ROM.

If the controller 100 determines that the amount is greater than or equal to the threshold (step S23; YES), the controller 100 sets the filling time Tm to Tm1 and the replenishment interval Td to Td3 (step S24). In other words, in a case that sufficient toner is held in the toner cartridge 55, the controller 100 sets the filling time Tm1, which is comparatively short, in this step S24. Meanwhile, if the controller 100 determines that the amount is smaller than the threshold (step S23; NO), the controller 100 sets the filling time Tm to Tm2 and the replenishment interval Td to Td4 (step S25). In other words, in a case that the amount of toner held in the toner cartridge 55 is comparatively small, the controller 100 sets the filling time Tm2, which is longer than the filling time T1. In a case that the amount of toner held in the toner cartridge 55 is small, as described above, toner carrying efficiency in the carry path 551 of the toner cartridge 55 decreases compared to that in a case that the amount of toner held is large. Therefore, when the amount of toner held is small, the controller 100 extends the filling time Tm to supply a sufficient amount of toner to the carry path 551. In other words, when the total amount of toner held in the toner cartridge 55 is greater than or equal to the threshold, the controller 100, which functions as a supply control unit, shortens the filling time Tm compared to that in a case that the amount is smaller than the threshold. In the amount of toner held in the toner cartridge 55, the amount greater than or equal to the threshold is an example of a first amount and the amount smaller than the threshold is an example of a second amount.

In this way, when the controller 100 sets the filling time Tm and the replenishment interval Td, and stores the settings in the storage unit 250. The controller 100 also updates the settings at periodic intervals in the same manner as described in the first exemplary embodiment. The filling time Tm1, Tm2 and the replenishment interval Td3, Td4 are predetermined such that an excessive amount of toner is not supplied to the development unit 17, even if toner is supplied during the term.

(B-2) Toner Recovery

Next, the "toner recovery" steps executed by the controller 100 are described.

Figure 14:
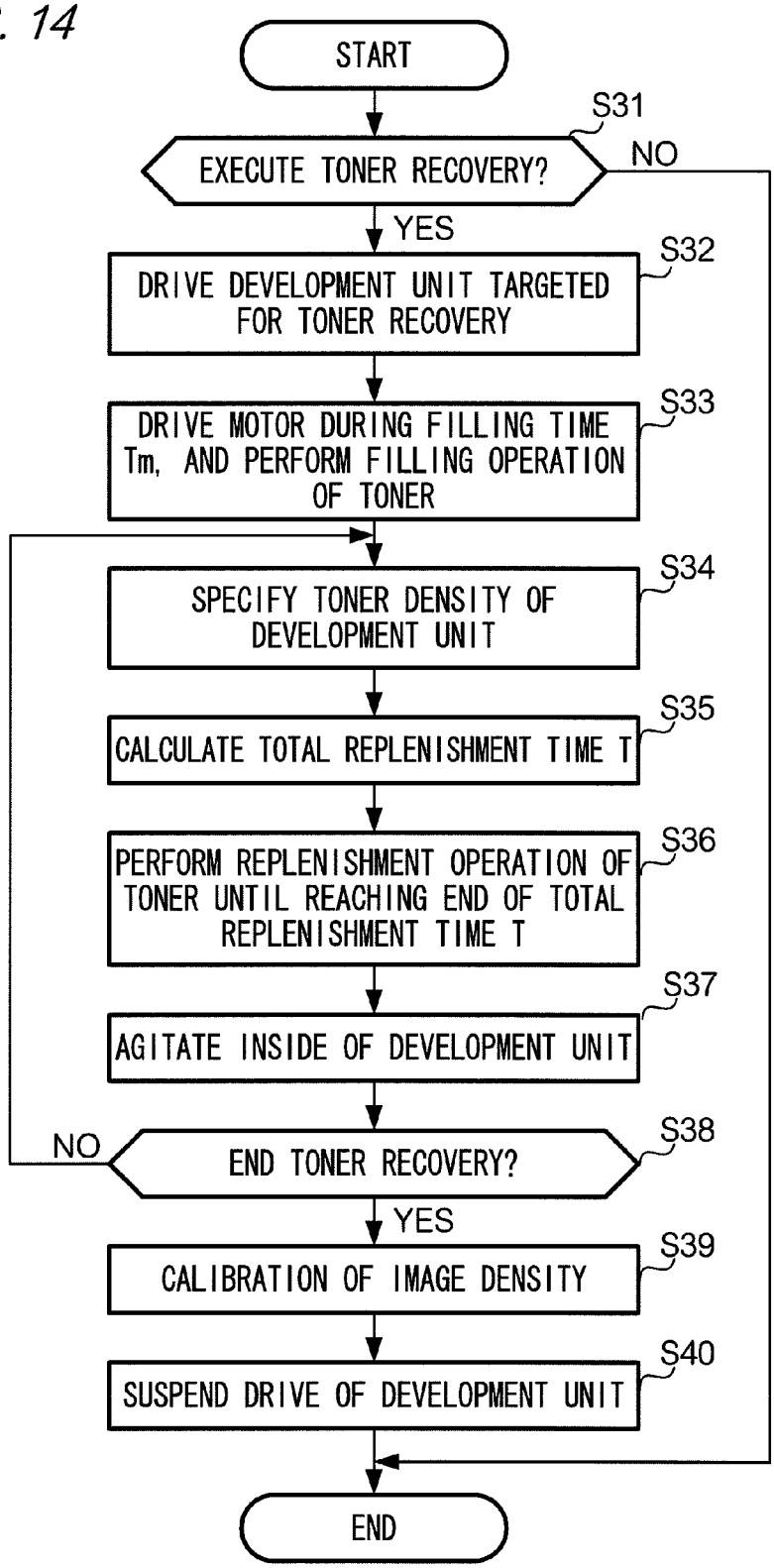
FIG. 14 is a flowchart showing a toner recovery executed by the image-forming apparatus.

FIG. 14 is a flowchart showing processing steps executed when the controller 100 carries out the toner recovery.

First, the controller 100 determines whether to execute the toner recovery (step S31). For example, the controller 100 detects a toner density in the development unit 17 by the density sensor 178, if the detected result indicates that the toner cartridge 55 is empty, and the controller 100 starts the toner recovery. More specifically, in a case that the toner density level in the development unit 17 is significantly low (is smaller than or equal to a threshold) even though the controller 100 drives the motor 300 and performs the replenishing operation of toner, the controller 100 determines that toner is not held in the toner cartridge 55 and the carry path 551. When a toner cartridge 55 has been attached to the image-forming apparatus 1, the controller 100 starts the toner recovery.

The controller 100 determines to execute the toner recovery (step S31; YES), it drives the development unit 17 targeted for the toner recovery (step S32). Next, the controller 100 drives the motor 300 during the filling time Tm, and it performs a filling operation that fills toner to the carry path 551 from the toner cartridge 55 (step S33). As described in the paragraph "(B-1) Setting of Filling Time Tm and Replenishment Interval Td," the filling time Tm is set in the steps in FIG. 13. Thus, toner is filled to the carry path 551 from the toner cartridge 55. Next, the controller 100 specifies a toner density in the development unit 17 based on a result detected by the density sensor 178 (step S34). Also, the controller 100 calculates the total replenishment time T, which is used to supply the toner to the development unit 17, to make the toner density specified in step S34 equal to the target density (step S35). The total replenishment time T can be calculated using the same technique as described in the paragraph "(A-2-2) Calculation Process of Total Replenishment Time."

The controller 100 performs the replenishment operation of toner, alternating between the actual replenishment term and the suspend replenishment term at the replenishment interval Td as shown in FIG. 6 until reaching an end of the total replenishment time T (step S36). By this operation, toner filled in the carry path 551 is replenished to the development unit 17, in addition, new toner is replenished to the carry path 551 from the toner cartridge 55. When the controller 100 performs the replenishment operation until the end of the total replenishment time T, it rotates the agitating auger 176 in the development unit 17 and agitates the inside of the development unit 17 (step S37). Also, the controller 100 determines whether to end the toner recovery (step S38). For example, the controller 100 controls such that a toner image for detection is formed on the photosensitive drum 15, detects an image density, and calculates a difference between the target density and the detected density. Further, the controller 100 determines whether the difference is within an acceptable range; if the difference is smaller than a predetermined value, it assumes that the toner recovery is successful, and determines that toner recovery ends (step S38; YES). Meanwhile, if the difference is greater than or equal to the predetermined value, the controller 100 assumes that the toner recovery is incomplete, determines that toner recovery does not end, and returns to step S34.

When the controller 100 determines "YES" in step S38, and the toner recovery ends, the controller 100 carries out a calibration of an image density (step S39). Here the controller 100 sets an image-forming condition, such as a charging potential, an exposure amount, a development bias potential, a primary transfer potential and a second transfer potential, for forming a toner image with a target image density. When the calibration of the image density ends, the controller 100 suspends the drive of the development unit 17 (step S40), and it ends the toner recovery.

In the second exemplary embodiment described above, the controller 100 varies the filling time Tm, which is a term of the replenishment operation performed to fill toner to the carry path 551 and the development unit 17, based on the amount of toner held in the cartridge 55 at the toner recovery. In this second exemplary embodiment, in a case that the amount of toner held is large, the controller 100 shortens the filling time Tm, and in a case that the amount of toner is small, it extends the filling time Tm. By this control process, the fluctuation of the toner amount replenished at the toner recovery can be kept small, regardless of an amount of toner held in the toner cartridge 55. Therefore, occurrence of an image defect is restrained by the same action as described in the first exemplary embodiment, and the determined filling time is a value adapted to the amount of toner held, so the term for toner recovery to complete does not take a long time.

Also, the image-forming apparatus 1 according to this second exemplary embodiment may perform the foregoing controls using the control operations described in the first exemplary embodiment, or it may perform the foregoing controls without the control operations described in the first exemplary embodiment.

(C) THIRD EXEMPLARY EMBODIMENT

Next, a third exemplary embodiment according to the present invention is described.

In this third exemplary embodiment, the controller 100 performs different controls, but the configuration of the image-forming apparatus 1 is same as that in the first exemplary embodiment. Therefore, the same configurations as described in the first exemplary embodiment are labeled using the same letters and numbers, and descriptions of the configurations are omitted.

In a case that electrophotographic image-forming apparatuses perform an operation to form an image and then perform an operation to form a next image, they set a term known as "imaging interval" between those operations. In other words, "imaging interval" is a term during between the image-forming processing and the subsequent image-forming processing. In this imaging interval, the image-forming apparatuses change an image-forming condition, such as a charging potential to charge a photosensitive drum, a development bias potential to develop electrostatic latent images on the photosensitive drum, and so on, and form a patch of toner for automatic calibration of a density. In this third exemplary embodiment, the controller 100 agitates developing agents by the agitating auger 176 of the development unit 17 during this imaging interval, and varies a length of the imaging interval based on an amount of toner held in the toner cartridge 55. More specifically, if the amount of toner held in the toner cartridge 55 is large, the controller 100 extends the imaging interval and thus extends an agitating term. The agitating term is a term during which the controller 100 drives the agitating auger 176 and agitates development agents. Meanwhile, if the amount of toner held in the toner cartridge 55 is small, the controller 100 shortens both the imaging interval and the agitating term compared to that in a case that the amount is large.

As described in the foregoing first and second exemplary embodiment, the greater the amount of toner held in the toner cartridge 55 is, the greater the amount of toner supplied in a unit of time is, so the more easily an excessive amount of toner is supplied to the development unit 17, and a toner density becomes high easily. If the toner density becomes excessively high, an agitating action by the agitating auger 176 decreases, so the agitating term has to be longer to achieve sufficient effect of agitating. Therefore, if the amount of toner held is greater than a threshold (a first amount), the controller 100, which functions as a supply control unit, controls the agitating term (in other words, the imaging interval) to be longer, compared to that in case that the amount of toner held is smaller than the threshold (a second amount). By this control process, occurrence of an image defect owing to an agitating defect of development agents in the development unit 17 is restrained. Meanwhile, if the amount of toner held in the toner cartridge 55 is small, the agitating defect is slight, so the controller 100 shortens the imaging interval, and it performs an image-forming operation at once.

Also, the image-forming apparatus 1 according to this third exemplary embodiment may perform the foregoing controls using the controls described in the first exemplary embodiment or in the second exemplary embodiment, or it may perform the foregoing controls without the controls described in those exemplary embodiments.

(D) FOURTH EXEMPLARY EMBODIMENT

Next, a fourth exemplary embodiment according to the present invention is described.

In this fourth exemplary embodiment, the controller 100 performs different controls, but the configuration of the image-forming apparatus 1 is the same as that in the first exemplary embodiment. Therefore, the same configurations as described in the first exemplary embodiment are labeled using the same letters and numbers, and descriptions of the configurations are omitted.

Electrophotographic image-forming apparatuses make a transition to an operating mode in which development agents in a development unit are agitated by an agitating auger, at periodic intervals, and agitate development agents during the operating mode. In this fourth exemplary embodiment, if an amount of toner held is greater than a threshold (a first amount), the controller 100, which functions as a supply control unit, controls frequency of the transition to the operating mode to be higher compared to that in a case that the amount of toner held is smaller than the threshold (a second amount). In this fourth exemplary embodiment, if the amount of toner held is large, and the agitating defect of agitating agents in the development unit 17 occurs easily, the frequency of the transition to the operating mode becomes higher, so occurrence of an image defect owing to the agitating defect is restrained. If the amount of toner held is small, and the agitating defect is slight, the controller 100 does not make a transition to the operating mode in which the controller 100 agitates development agents with more frequency than necessary.

Also, the image-forming apparatus 1 according to this fourth exemplary embodiment may perform the foregoing controls using the controls described in the first to third exemplary embodiments, or it may perform the foregoing controls without the controls described in those exemplary embodiments.

(E) MODIFICATIONS

The present invention can be practiced as a different exemplary embodiment from the foregoing exemplary embodiments. Also, the modifications described below may be combined with each other.

(E-1) Modification 1

In the foregoing first to fourth exemplary embodiments, the controller 100 is built into the image-forming apparatus 1, but the controller 100 may be realized by an information processing apparatus that is located outside of the image-forming apparatus 1. The information processing apparatus is, for example, a personal computer that controls the image-forming apparatus 1.

Also, each program executed by the CPU of the controller 100 can be provided stored in a recording medium, which is computer readable. The recording medium is, for example, a magnetic recording medium such as a magnetic tape, a magnetic disk, and so on, an optical recording medium such as an optical disk, a magneto-optical recording medium, or a semiconductor memory.

Further, these programs can be downloaded via a network such as the Internet. Furthermore, not only the CPU but also various devices can be used to execute those controls. For example, a dedicated processor may be used as the configuration that executes those controls.

(E-2) Modification 2

In the foregoing first to fourth exemplary embodiments, the controller 100 distinguishes between a case that an amount of toner held is large and a case that the amount of toner held is small, based on whether an amount of toner held in the toner cartridge 55 is greater than or equal to the threshold. The present invention is not limited to this configuration, but the controller 100 may distinguish the amount of toner held by dividing each case into many more stages, and perform a control based on each of the stages. In this case, in the first exemplary embodiment, the controller 100 also performs the control such that the greater an amount of toner held is, the smaller an amount of toner supplied per unit of time is, and in the second exemplary embodiment, the controller 100 also performs the control such that the greater an amount of toner held is, the shorter the filling term Tm in the toner recovery becomes. Also, in this case, the controller 100 may calculate an amount of toner supplied using a calculation formula that is determined from an amount of toner held, or, the ROM or the like stores a correspondence relation between an amount of toner held and a content determined in each of the controls, and the controller 100 may perform a control using the correspondence relation.

(E-3) Modification 3

In the foregoing first and second exemplary embodiment, the controller 100 controls a length of the actual replenishment term, and it varies an amount of toner replenished in a unit of time. However the controller 100 may instead change the number of rotations of the motor, and vary an amount of toner replenished. In this case, the controller 100 may fix the drive time of the motor 300, or it may change the drive time. Also, a driving unit that generates drive force to carry toner from toner cartridge 55 is not limited to a motor, but it may be applied to a driving unit that supplies an amount of toner by a control of the controller 100. Further, in the foregoing exemplary embodiments, the controller 100 calculates the total replenishment time T using both the density detection method and the pixel count method, but it may calculate the total replenishment time T using either one of those methods or another method.

(E-4) Modification 4

The controller 100 may perform the replenishment operation of toner described in the first exemplary embodiment only in a case that a determined condition is satisfied. The determined condition is a case that, for example, the image-forming apparatus 1 forms an image having a high density, such as a photograph and so on. In this case, the controller 100 needs to supply a large amount of toner to the development unit 17, so an excessive amount of toner is supplied to the development unit 17 easily. Meanwhile, in a case of forming an image having comparatively low density such as a document, an amount of toner replenished is comparatively small, so a possibility that an excessive amount of toner is replenished is low. Therefore, the controller 100 may analyze image data supplied for image-forming, and determine whether to execute the replenishment operation of toner based on whether an amount of toner consumed to form an image from the image data is large.

(E-5) Modification 5

In the foregoing first exemplary embodiment, the controller 100 may change only the suspend replenishment term, keeping the maximum replenishment term Tmax, and control an amount of toner replenished in a unit of time. In this configuration also, the longer the suspend replenishment term is, the lower a frequency that toner is supplied to the development unit 17 becomes, so the controller 100 agitates development agents by the agitating auger 176 during the suspend replenishment term, and the same effect as described in the exemplary embodiments is accomplished.

(E-6) Modification 6

Here, a reason that an amount of toner discharged to the carry path 551 from the toner cartridge 55 (in another words, an amount of toner replenished to the development unit 17) fluctuates based on an amount of toner held in the toner cartridge 55 is described.

Figure 15:
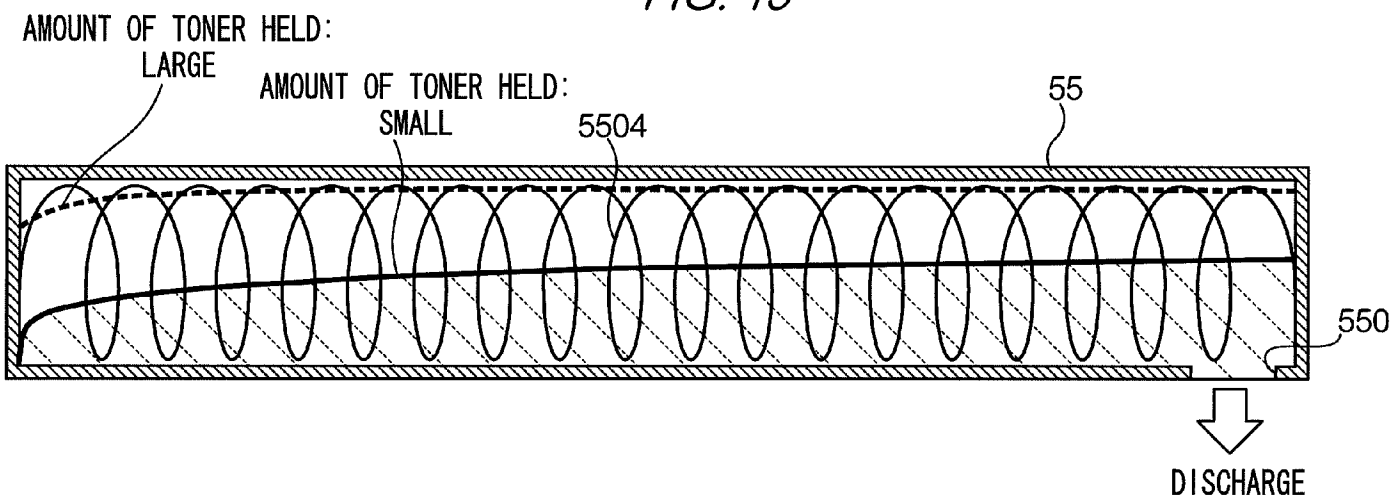
FIG. 15 is a diagram showing the inside of the toner cartridge.

FIG. 15 shows a state of the inside of the toner cartridge 55. FIG. 15 is a sectional view of the toner cartridge 55, viewed in the direction shown by arrow "S" in FIG. 4, as in FIG. 5. In FIG. 15, a solid line indicates a region of toner when a volume of toner occupying a capacity of the toner cartridge 55 decreases to approximately 50%, and a dotted line indicates a region of toner when the volume of toner is almost 100% and an amount of the toner is large.

As shown in FIG. 15, comparing a case that an amount of toner held is large and a case that the amount is small, an amount of toner above the hole 550 is different, and an amount of toner discharged is different owing to this difference even if a number of rotations of the carry member 5504 are the same. More specifically, the greater an amount of toner above the hole 550 is, the greater an amount of toner discharged per unit of time is, on the other hand, the smaller an amount of toner above the hole 550 is, the smaller an amount of toner discharged per unit of time is. Also, when an amount of toner held in the toner cartridge 55 progressively decreases, toner piled up in the toner cartridge 55 collapses, and an amount of toner discharged starts to decrease when this collapse occurs. According to this kind of cause, an amount of toner discharged varies based on an amount of toner held in the toner cartridge 55.

Figure 16:
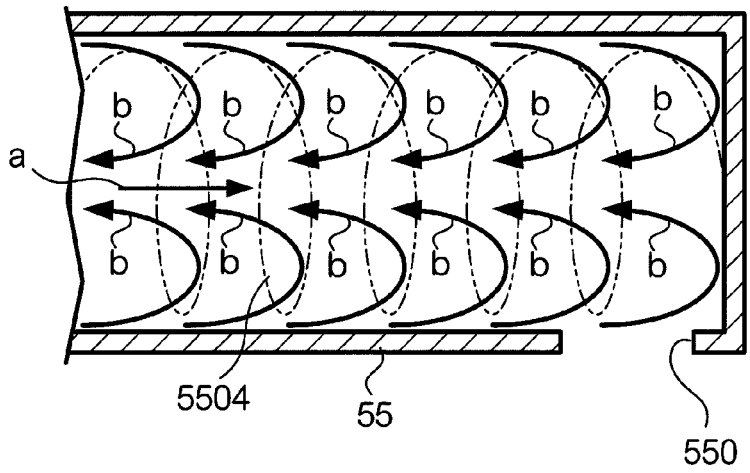
FIG. 16 is a diagram to describe a moving state of toner in the toner cartridge.

FIG. 16 shows a moving state of toner in the toner cartridge 55 in a case that an amount of toner held decreases to some extent. In FIG. 16, moving directions of toner are indicated by arrows. In a case that an amount of toner held in the toner cartridge 55 decreases to some extent, toner is moved in a direction shown by arrow "a", which is downstream of a carry direction, by rotation of the carry member 5504; also, toner is moved around a center of the carry member 5504, which is coiled to form a cylindrical shape, in a direction shown by arrow "b" that is upstream of the carry direction. Carry force for moving in a direction shown by arrow "a" easily acts on toner located near the carry member 5504 by pressure force and friction force produced by rotation of the carry member 5504, but the carry force for moving in a direction shown by arrow "a" does not act as effectively on toner located far from the carry member 5504. Some toner will be pushed out by another toner and move to upstream of the carry direction. In this case, some toner is moved in a direction shown by arrow "a" and some in a direction shown by arrow "b," but an amount of toner discharged from the hole 550 in a unit of time becomes comparatively stable. Meanwhile, in a case that an amount of toner held is almost 100% as shown by the dotted line in FIG. 15, a chamber in the toner cartridge 55 is almost filled with toner, so even if toner tends to move to the upstream (the direction shown by arrow "b"), very little of the chamber is used therefor. In this case, toner hardly moves to the upstream, and an excessive amount of toner is discharged easily. Also, when an amount of toner held is large, an agitating defect also occurs easily. If toner clumps together, an amount of toner discharged decreases even if a large amount of toner is held in the toner cartridge 55. On the other hand, when an amount of toner held decreases and the agitating starts to be performed satisfactorily, a large amount of toner is discharged at once. For reasons such as these, an amount of toner discharged varies in a case that a large amount of toner is held in the toner cartridge 55.

Figure 17:
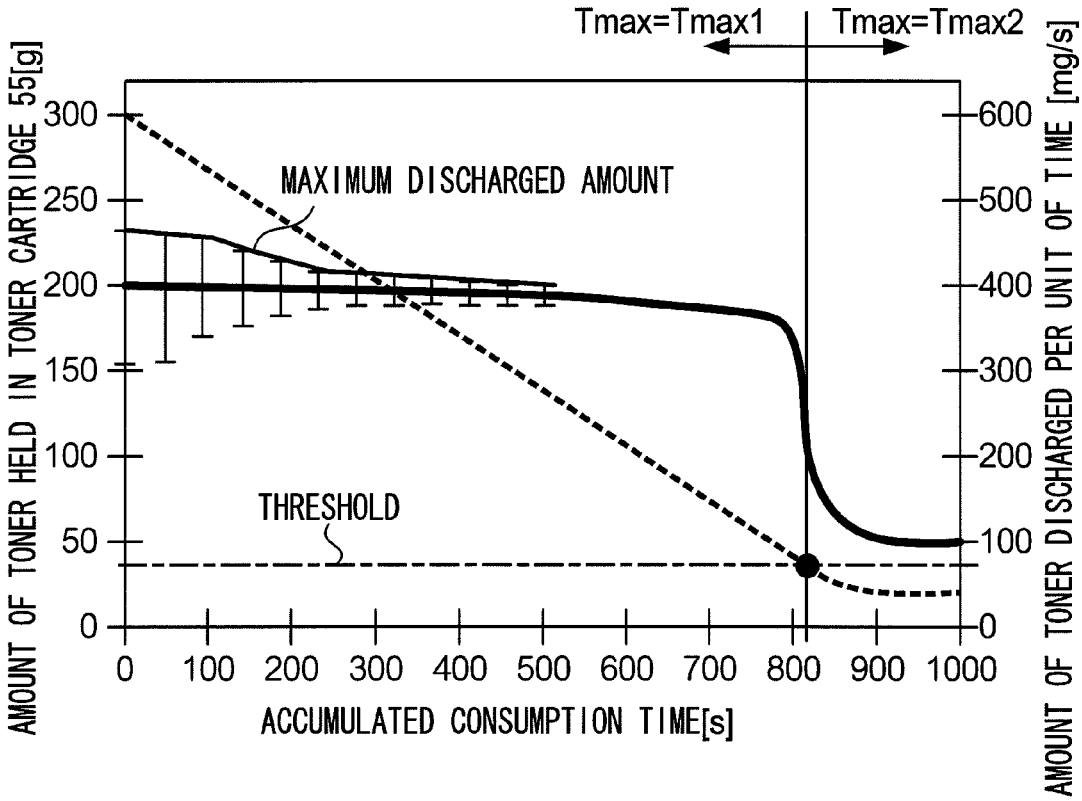
FIG. 17 is a graph showing an example of a relation between an accumulated consumption time, an amount of toner held in the toner cartridge, and an amount of toner discharged per unit of time.

FIG. 17 is a graph showing an example of a relation between an accumulated consumption time [s], which starts from the toner cartridge 55 that is attached to the image-forming apparatus 1 in a condition that toner is almost 100%, an amount of toner [g] held in the toner cartridge 55, and an amount of toner discharged per unit of time [mg/s]. A solid line in the graph indicates an amount of toner discharged per unit of time, and a dotted line in the graph indicates an amount of toner held in the toner cartridge 55. Also, a mark that will be referred to as "I" (a vertical bar, the at the top and bottom of which there is a horizontal bar) added to the graph indicates a range of fluctuation of a discharged amount in each accumulated consumption time (called "fluctuation range" hereinafter). An upper horizontal bar of the "I" indicates an upper limit value of the discharged amount, and a lower horizontal bar of the "I" indicates a lower limit value of the discharged amount.

As shown in FIG. 17, when the accumulated consumption time exceeds 500 [s] and an amount of toner held decreases to some extent, a discharged amount becomes stable, so a relation between the accumulated consumption time and the held amount is uniquely estimated. Meanwhile, the discharged amount fluctuates greatly when the accumulated consumption time is shorter than 500 [s], especially while the accumulated consumption time is shorter than 100 [s], the fluctuation is greater. If this kind of fluctuation occurs, sometimes an excessive amount of toner is replenished to the development unit 17. If an excessive amount of toner is replenished, there is a possibility that a charging defect of developing agents in the development unit 17 and the photosensitive drum 15 occurs, an image defect occurs, or the inside of the apparatus is damaged. Therefore, the controller 100 performs a replenishment operation of toner as described below.

More specifically, as shown in the graph in FIG. 17, when an amount of toner held in the toner cartridge 55 is large, the controller 100 determines a replenished amount to be such that an amount of toner discharged becomes maximum within the fluctuation range. In other words, the controller 100 makes a determination that an amount of toner indicated in the graph in FIG. 17 as a line linking each of the upper limit values in the fluctuation range, is discharged in a unit of time. This can ensure that an excessive amount of toner is not replenished to the development unit 17, even if the discharged amount becomes excessively high. Meanwhile, in a case that an amount of toner, which is indicated by the lower side in the fluctuation range, is discharged, an amount of toner replenished to the development unit 17 becomes insufficient, but when the controller 100 determines replenishment insufficiency from the result detected by the density sensor 178, it performs the replenishment operation by the density detection method at once, so the replenishment insufficiency is resolved immediately.

A configuration and operation of the image-forming apparatus 1 relating to the foregoing replenishment operation of toner is described.

First, an operation according to a setting of maximum replenishment term Tmax is described. The controller 100 specifies the maximum replenishment term Tmax based on the accumulated consumption time. When the controller 100 performs the replenishment operation of toner, it stores the accumulated consumption time in the storage unit 250 based on the term; here it reads out the accumulated consumption time from the storage unit 250 and specifies the maximum replenishment term Tmax. The shorter the accumulated consumption time is, the greater the amount of toner discharged per unit of time is, so in this case, controller 100 sets the maximum replenishment term Tmax1 that is comparatively short such that an excessive amount of toner is not discharged. Meanwhile, the longer the accumulated consumption time is, the smaller the amount of toner discharged per unit of time is, so the controller 100 sets the maximum replenishment term Tmax2 that is longer than the maximum replenishment term Tmax1 such that an amount of toner replenished is not insufficient. The use of either of the maximum replenishment terms is determined based on whether an amount of toner held in the toner cartridge 55 is greater than or equal to the threshold, as shown in FIG. 17. In FIG. 17, when an amount of toner held is greater than or equal to about 40 [g] the controller 100 sets the maximum replenishment term to be Tmax1; meanwhile, when the amount of toner held is smaller than 40 [g] the controller 100 sets the maximum replenishment term to be Tmax2. The controller 100 reads out information related to a remaining amount of toner from the foregoing memory, and specifies the amount of toner held in the toner cartridge 55.

Next, a configuration and operation according to a calculation process of the total replenishment time is described.

First, the image-forming apparatus 1 stores, in advance, correspondence relationship data to express a correspondence relationship between the accumulated consumption time shown in FIG. 17 and the amount of toner discharged per unit time. The amount of toner discharged per unit of time is measured by experiment, and upper limit values of the measured amount of toner are used in this correspondence relationship. In the calculation process of the total replenishment time, first the controller 100 specifies the amount of toner discharged per unit of time from the accumulated consumption time. The controller 100 also determines an amount of toner replenished by the foregoing density detection method or the pixel count method. The controller 100 assumes that an amount of toner of the upper limit values in the fluctuation range is discharged in a unit of time, and it calculates the total replenishment time T based on the correspondence relationship expressed by the correspondence relationship data stored in the storage unit 250.

As described above, in a case that an amount of toner held in the toner cartridge 55 is such that the discharged amount fluctuates, the controller 100 assumes that a discharged amount of toner is a maximum amount, which assumption can also be made by the image-forming apparatus 1 described in the first to fourth exemplary embodiments, and calculates the amount of toner replenished, so occurrence of an adverse situation that an excessive amount of toner is replenished to the development unit 17 in an operation of the apparatus is avoided.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A supply control apparatus comprising:

a specifying unit that specifies a total amount of toner held in a holding chamber of a toner holding unit; and a supply control unit that controls supply of toner held in the holding chamber to a development unit that develops a latent image using the toner, wherein a carrying efficiency of the supply control unit under a condition in which the specified total amount is a first amount, is greater than a carrying efficiency of the supply control unit under a condition in which the specified total amount is a second amount, the second amount is smaller than the first amount and the supply control unit controls supply of toner so that a target amount of toner is supplied to the development unit regardless of whether the specified total amount is the first amount or the second amount.

2. The supply control apparatus according to claim 1, wherein the supply control unit alternates between a first term in which the toner is supplied to the development unit and a second term in which the toner is not supplied to the development unit, and when the specified total amount is the first amount, controls such that a ratio of the first term to the second term is smaller than the ratio when the total amount is the second amount.

3. The supply control apparatus according to claim 2, further comprising:

a setting unit that sets a maximum time defining a maximum length of the first term, wherein when the specified total amount is the first amount, the setting unit sets the maximum time such that a ratio of the maximum time to the second term is smaller than the ratio when the total amount is the second amount;

wherein the supply control unit sets a length of the first time to the maximum time in a case that supply time of the toner is longer than the maximum time, subtracts the maximum time from the supply time, and adds the resulting time to the subsequent first term.

4. A supply control apparatus comprising:

a specifying unit that specifies a total amount of toner held in a holding chamber of a toner holding unit; and a supply control unit that controls supply of toner held in the holding chamber to a development unit that develops a latent image using the toner via a carry unit including the holding chamber, wherein a carrying efficiency of the supply control unit under a condition in which the specified total amount is a first amount, is greater than a carrying efficiency of the supply control unit under a condition in which the specified total amount is a second amount, the second amount is smaller than the first amount and the supply control unit controls supply of toner so that a target amount of toner is supplied to the development unit regardless of whether the specified total amount is the first amount or the second amount.

5. An image-forming apparatus comprising:

a specifying unit that specifies a total amount of toner held in a holding chamber of a toner holding unit;

a supply control unit that controls supply of toner held in the holding chamber to a development unit that develops a latent image using the toner;

an image supporter;

a charging unit that charges a surface of the image supporter;

a latent image-forming unit that forms a latent image on the surface of the charged image supporter;

a development unit that develops the formed latent image with toner supplied based on the control performed by the supply control unit; and a transfer unit that transfers the developed image;

wherein a carrying efficiency of the supply control unit under a condition in which the specified total amount is a first amount, is greater than a carrying efficiency of the supply control unit under a condition in which the specified total amount is a second amount, the second amount is smaller than the first amount and the supply control unit controls supply of toner so that a target amount of toner is supplied to the development unit regardless of whether the specified total amount is the first amount or the second amount.

6. A supply control method comprising:

specifying a total amount of toner held in a holding chamber of a toner holding unit; and controlling supply of toner held in the holding chamber to a development unit that develops a latent image using the toner;

wherein a carrying efficiency of a supply control unit that supplies the toner under a condition in which the specified total amount is a first amount, is greater than a carrying efficiency of the supply control unit under a condition in which the specified total amount is a second amount, the second amount is smaller than the first amount and the supply of toner is controlled so that a target amount of toner is supplied to the development unit regardless of whether the specified total amount is the first amount or the second amount.

7. A supply control method comprising:

specifying a total amount of toner held in a holding chamber of a toner holding unit; and controlling supply of toner held in the holding chamber to a development unit that develops a latent image using the toner via a carry unit including the holding chamber;

wherein a carrying efficiency of a supply control unit that supplies the toner under a condition in which the specified total amount is a first amount, is greater than a carrying efficiency of the supply control unit under a condition in which the specified total amount is a second amount, the second amount is smaller than the first amount and the supply of toner is controlled so that a target amount of toner is supplied to the development unit regardless of whether the specified total amount is the first amount or the second amount.

* * * * *